US009580259B1

(12) United States Patent
McFarland et al.

(10) Patent No.: US 9,580,259 B1
(45) Date of Patent: Feb. 28, 2017

(54) REMOVABLE MEDIA TRAY HAVING A RACK AND PINION MEDIA LENGTH SENSING MECHANISM OPERABLE BY A REAR RESTRAINT

(71) Applicant: LEXMARK INTERNATIONAL, INC., Lexington, KY (US)

(72) Inventors: Neal Douglas McFarland, Versailles, KY (US); Dustin Daniel Fichter, Versailles, KY (US); Pat Marlon Cartagena Limosnero, Cebu (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/135,975

(22) Filed: Apr. 22, 2016

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2301/141* (2013.01); *B65H 2301/4222* (2013.01); *B65H 2405/11* (2013.01); *B65H 2405/1116* (2013.01); *B65H 2405/1122* (2013.01); *B65H 2511/10* (2013.01)

(58) Field of Classification Search
CPC ..... B65H 1/266; B65H 2301/141; B65H 2301/4222; B65H 2405/1116; B65H 2405/1122; B65H 2405/32; B65H 2405/31; B65H 2511/10; B65H 2511/11; B65H 2511/416
USPC ..... 271/171
See application file for complete search history.

(56) References Cited

U.S. PATENT DOCUMENTS 6,014,229 A * 1/2000 Yun ..... H04N 1/00681 271/171
6,254,085 B1 * 7/2001 Kang ..... B65H 1/04 271/171
6,805,345 B2 * 10/2004 Furukawa ..... B65H 1/04 271/171
6,901,820 B2 * 6/2005 Imahara ..... B65H 1/00 399/389
7,144,007 B2 * 12/2006 Kim ..... H04N 1/00708 271/171
7,413,188 B2 * 8/2008 Miki ..... B65H 1/266 271/171
7,516,955 B2 * 4/2009 Yamagishi ..... B65H 1/266 271/171
7,540,677 B2 * 6/2009 Allwright ..... B41J 13/103 271/162
8,061,708 B2 * 11/2011 Fujita ..... B65H 1/266 271/145

* cited by examiner

*Primary Examiner* — Ernesto Suarez
(74) *Attorney, Agent, or Firm* — John Victor Pezdek

(57) ABSTRACT

A removable media tray for an imaging device having a rear media restraint coupled to a media length sensing system. A rear media restraint, slideably latchable to a track in the tray, has a rack that engages with a gear train that drives an encoder gear. As the rear media restraint is adjusted for different media lengths, the rack and gear train rotate the encoder gear. The encoder gear has a plurality of encoder tracks each track having a unique binary pattern. A sensor array of a plurality of sensors corresponding to the plurality of encoder tracks has a plurality of outputs that combine to form a digital signal fed to a controller in the imaging device allowing the controller to determine a media length based in the position of the rear media restraint.

22 Claims, 17 Drawing Sheets

REMOVABLE MEDIA TRAY HAVING A RACK AND PINION MEDIA LENGTH SENSING MECHANISM OPERABLE BY A REAR RESTRAINT

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media input feed systems for an imaging device having a removable media tray with a media length sensing mechanism.

Description of the Related Art

Imaging devices utilize removable media trays for holding stack of media to be processed by the imaging device. The removable media tray is designed to handle a variety of different length media, such as A6, Letter, A4 and Legal media having lengths of 148 mm, 279 mm, 297 mm and 356 mm, respectively. To determine the length of the selected media, sensors may be provided in the removable media tray at each media length and then polled by a controller to determine the selected media length. Another approach is to use a bank of switches connected to a controller that are actuated by a series of levers that are controlled using a series of linear openings in a rectangular linear encoder plate. The encoder plate is translated by one end of a pivoting link, mounted to an undersurface of the removable media tray. The other end of the link is attached to the rear media restraint via a slot in the bottom of the removable media tray. As the media restraint is moved, the link pivots, in turn sliding the encoder plate. However, this mechanism is bulky and requires a large footprint within the removable media tray to accommodate the encoder plate and the pivoting arm.

It would be advantageous to have a mechanism that would allowing for media length sensing that is more compact than the prior art design. It would be further advantageous that the mechanism for operating the encoder or the switches be contained within the interior of the media tray.

SUMMARY OF THE INVENTION

Disclosed is a removable media tray for an imaging device having a gear driven encoder system for determining media length based on the position of a rear media restraint in the removable media tray. The removable media tray comprises a bottom for holding media to be fed to the imaging device, a side wall attached to a side of the bottom surface, a track having a plurality of serrations along a length thereof and positioned on an upper surface of the bottom parallel to the side wall, and a user-actuated media restraint for restraining a rear edge of the media when present. The media restraint is slidably engageable with the track. The media restraint includes a bottom plate having a rack extending along a side edge thereof parallel to the side wall.

A gear train engages with the rack and includes M rack gears and M−1 idler gears mounted to the bottom. The M rack gears are spaced apart along a common centerline that is parallel to the side wall. At least one rack gear is engaged with the rack. Each idler gear is rotatably coupled to adjacent rack gears and rotatably mounted to the bottom. An N track encoder gear is rotatably mounted to an inner face of the side wall and rotatably coupled to one of the M−1 idler gears. Each track of the encoder gear has a unique binary pattern. The gear train may further include an idler roll vertically and rotatably mounted on the side wall between a rear face of the encoder gear and the side wall with the idler roll being in contact with the rear face of the encoder gear. The gears in the gear train, the rack and the encoder gear may all have the same pitch diameter and gear module.

An encoder gear sensor assembly is provided adjacent to the encoder gear. The sensor assembly has N sensors with N output signals in communication with a controller of the imaging device. The N sensors and N output signals correspond to the N tracks of the encoder gear. Each sensor senses the unique binary pattern of the corresponding track of the encoder gear and provides the corresponding output signal representative of the sensed unique binary pattern. A combination of the N output signals forms a N-bit data signal having $2^N$ values representative of a plurality of positions of the media restraint along the track and of the absence of the removable media tray in the imaging device where the plurality of positions correspond to a plurality of designed-for media lengths. N may equal 3 or higher. The shortest designed-for media length may be A6 media and the longest designed-for media length may be Legal or Ledger media. The digital signal value of zero may represent the absence of the removable media tray from its installed positioned within the imaging device.

In one form the each sensor includes a cantilevered member and a switch having a two-state output in communication with the controller. The cantilevered member is mounted to the side wall adjacent to the encoder gear. The cantilevered member has a free end engaged with the corresponding encoder gear track and with the switch. As the encoder rotates the free end of the cantilever member rises and falls which in turn causes the two-state output of the switch to toggle between a first state and a second state.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 8A illustrates the media restraint in its first or engaged position and FIG. 8B illustrates the media restraint in an actuated or disengaged position.

FIG. 9A shows the first or latched position and FIG. 9B shows the second or unlatched position.

FIGS. 10-12 illustrate the media length sensing system of the present disclosure positioned at a shortest designed-for media length where in FIG. 10 the media restraint is positioned at its most forward point of travel and engaged with the most forward of the rack gears with FIG. 11 showing the state of the encoder gear at that position and FIG. 12 showing the state of the sensing mechanism at that same position.

FIGS. 13-15 illustrate the media length sensing system of the present disclosure positioned at a first intermediate designed-for media length where in FIG. 13 the media restraint is engaged with first two of the three rack gears with FIG. 14 showing the state of the encoder gear at that first intermediate position and FIG. 15 showing the state of the sensing mechanism at that same position.

FIGS. 16-18 illustrate the media length sensing system of the present disclosure positioned at a second intermediate designed-for media length where in FIG. 16 the media restraint is engaged with the three rack gears with FIG. 17 showing the state of the encoder gear at that second intermediate position and FIG. 18 showing the state of the sensing mechanism at that same position.

FIGS. 19-21 illustrate the media length sensing system of the present disclosure positioned at a third intermediate designed-for media length where in FIG. 19 the media restraint is engaged with the second and third rack gears with FIG. 20 showing the state of the encoder gear at that third intermediate position and FIG. 21 showing the state of the sensing mechanism at that same position.

FIGS. 22-24 illustrate the media length sensing system of the present disclosure positioned at a longest designed-for media length where in FIG. 22 the media restraint is engaged with the third of the three rack gears with FIG. 23 showing the state of the encoder gear at that longest designed-for media length position and FIG. 24 figure showing the state of the sensing mechanism at that same position.

FIG. 26 depicts optical sensors sending a light beam through the encoder gear, FIG. 27 depicts reflective photo sensors, FIG. 28 depicts switch type sensors being actuated/deactuated by raised and lower portions of the encoder gear, and, FIG. 29 depicts switch type sensors being actuated/deactuated by flat and recessed portions of the encoder gear.

DETAILED DESCRIPTION

Figure 1:
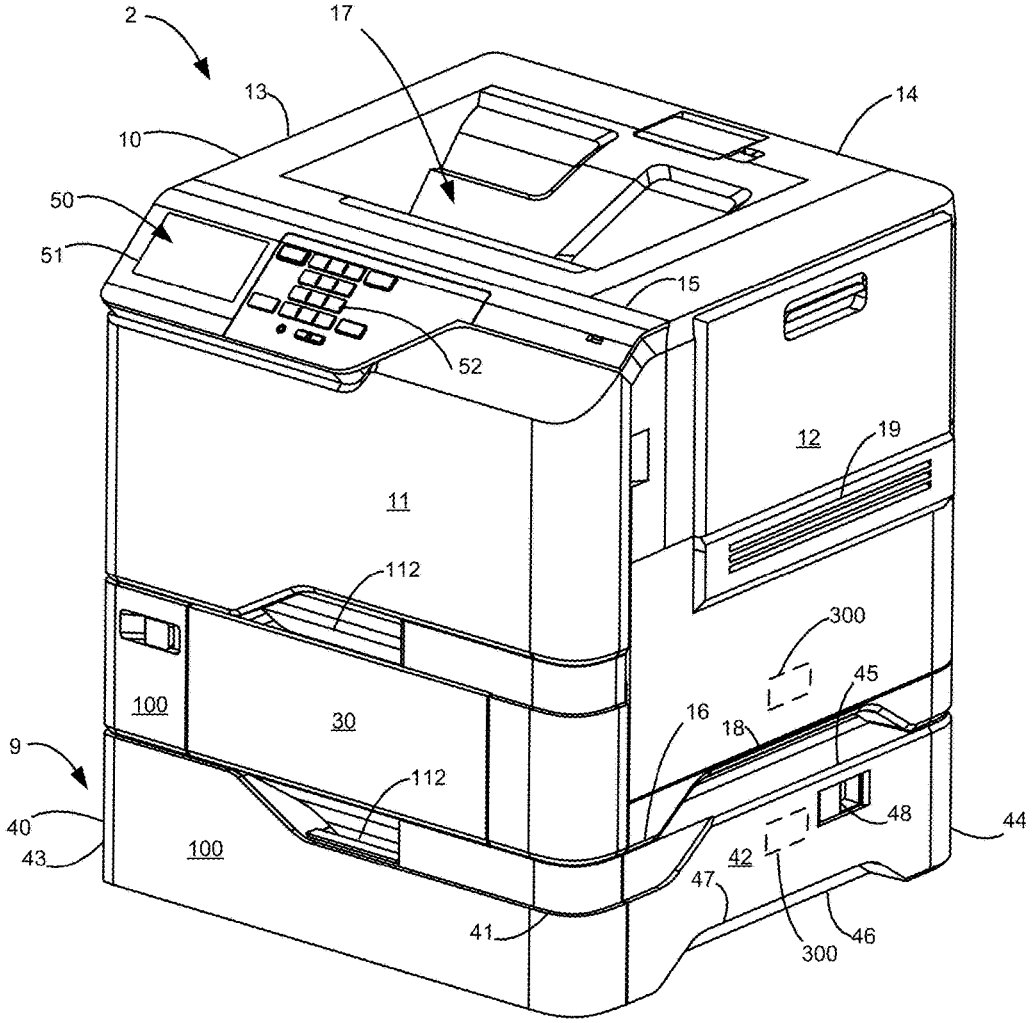
FIG. 1 is an illustration of an imaging device having a removable media tray attached to an option assembly also having a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media length sensing system of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "front" "rear" "left" and "right" as used herein for the removable media tray and its components are with reference to the removable media tray being inserted in the imaging device or option assembly as viewed in FIG. 1.

FIG. 1 illustrates an example imaging device 2 atop an example option assembly 9. Elements in option assemblies 9 that are the same as or similar to those found imaging device 2 will carry the same or similar reference numbers.

Imaging device 2 has a housing 10 having a front 11, a first (right) and second (left) sides 12, 13, a rear 14, a top 15 and a bottom 16 and into which a removable media tray 100 is slidably inserted. A media output area 17 for receiving printed media is provided in the top 15. Also, ventilation openings, such as vents 19 are provided on imaging device 2 such as those shown on first side 12. A user interface 50, comprising a display 51 and a key panel 52, may be located on the front 11 of housing 10. With user interface 50, a user is able to enter commands and generally control the operation of the imaging device 2. For example, the user may enter commands to switch modes (e.g., color mode, monochrome mode), view the number of images printed, take the imaging device 2 on/off line to perform periodic maintenance, and the like.

A multipurpose input tray 30 folds out from the front of the removable media tray 100 in imaging device 2 and may be used for handling envelopes, index cards or other media where only a small number of the media will be printed. The multipurpose tray 30 may also be incorporated into front 11 of housing 10 rather than being incorporated into removable media tray 100.

Option assembly 9 has a housing 40 having a front 41, a first (right) and second (left) sides 42, 43, a rear 44, a top 45 and a bottom 46 and into which a second removable media tray 100 is slidably inserted. A handle 112 is provided on each of the removable media trays 100 for tray insertion and removal. Hand grips 18, 47 are provided in several locations on housings 10, 40, respectively, such as on sides 12, 13, 43, 44. Latches 48 are provided on each option assembly 9 to secure it to either imaging device 2 or a superior option assembly 9 in the stack. An option assembly 9 may be removed or added to the stack. As each option assembly 9 is added, the media path is extended. The option assemblies 9 are stackable allowing one or more option assemblies 9 to be used with a single imaging device 2 that is typically positioned on top of the uppermost option assembly 9 in the stack. Typically, each option assembly 9 may contain a different type of media such as letterhead or a different size such as A4 or a larger quantity of the same media type that is found in the removable media tray 100 integrated into imaging device 2. Each removable media tray 100 is sized to contain a stack of media sheets that will receive color and/or monochrome images. Each removable media tray 100 may be sized to hold the same number of media sheets or may be sized to hold different quantities of media sheets. Example media sizes include but are not limited to A6, 8½"×11", A4, and Legal. In some instances, the removable media tray 100 in imaging device 2 may hold a lesser, equal or greater quantity of media than a removable media tray 100 found in an option assembly 9.

Also shown in imaging device 2 and in option assembly 9 is a sensor array 300 used with the media length sensing system of the present disclosure. Sensor arrays 300 are operatively coupled to corresponding elements of the media length sensing system mounted on each of removable media trays 100 as explained herein.

Figure 2:
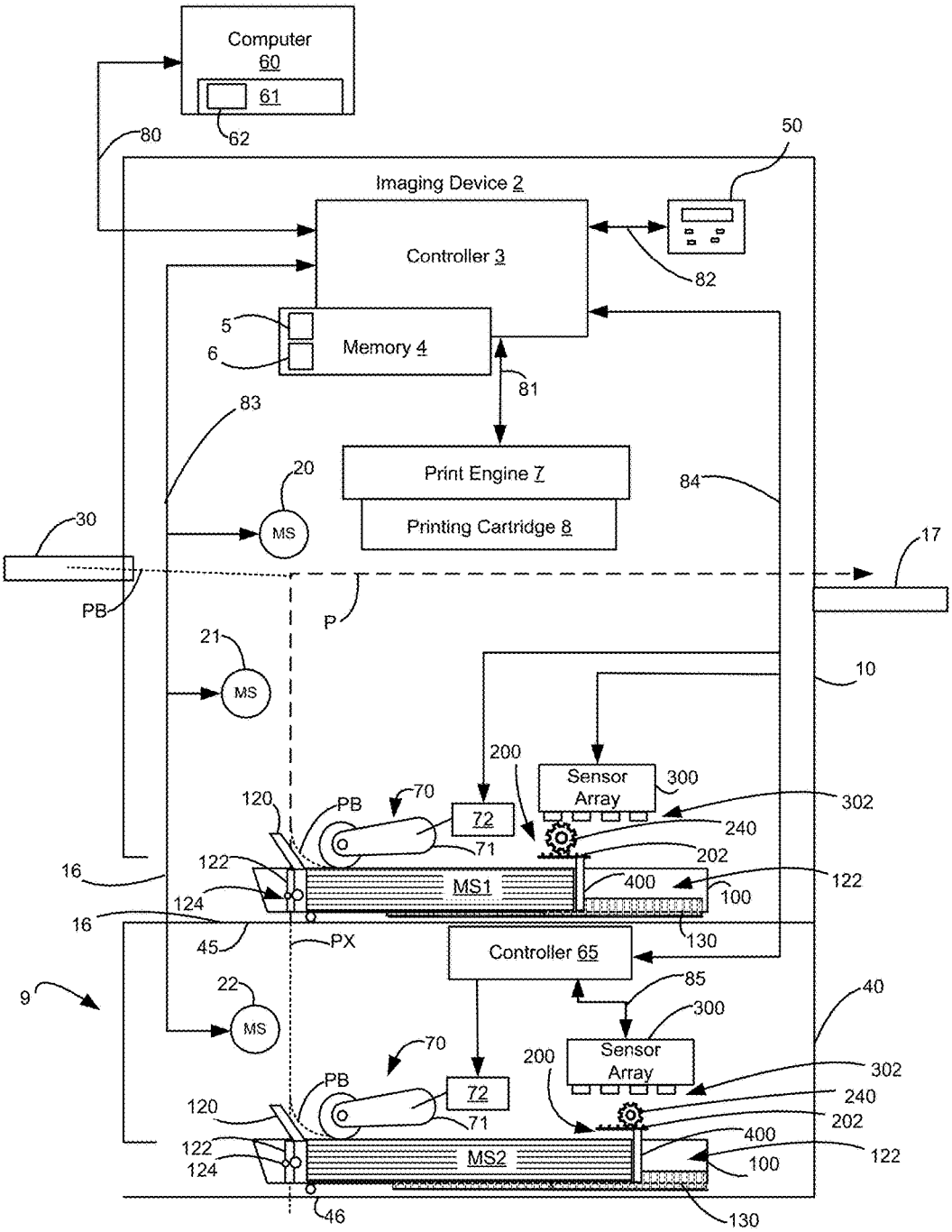
FIG. 2 is a schematic illustration of the imaging device and option assembly of FIG. 1 depicting the media length sensing system of the present disclosure.

Referring to FIG. 2, there is shown a diagrammatic depiction of imaging device 2 and option assembly 9. Imaging device 2 includes a controller 3, a print engine 7, a printer cartridge 8, a user interface 50, media position sensors 20, 21, a media feed system 70, a removable media tray 100, and a sensor array 300. Option assembly 9 includes a controller 65, a media position sensor 22, a media feed system 70, a removable media tray 100 and a sensor array 300. It will be recognized that additional option assemblies 9 may be provided either inferior to option assembly 9 or between option assembly 9 and housing 10 of imaging device 2. In imaging device 2, a media path P extends between removable media tray 100 to output area 17 going past print engine 7. A media path branch PB extends from multipurpose input tray 30 and merges with media path P adjacent to media sensor 20. A media path extension PX extends between the top 45 and bottom 46 of the housing 40 of each option assembly 9 that is used. The path extension PX extends through bottom 16 of housing 10 and merges with media path P in imaging device 2. Feed-through channels 122 and feed roll pairs 124 are provided on removable media trays 100 to allow a media sheet to be feed through the removable media trays 100 found in option assemblies 9. Media feed system 70 includes a pick mechanism 71 and a pick drive 72 used to feed a media sheet from removable media tray 100 into media path P or path extension PX. An optional computer 60 is also shown attached to the imaging device 2.

Along media path P and its extensions PX are provided media position sensors 20-22 which are used to detect the position of the media sheet, usually the leading and trailing edges of the media sheet, as it moves along the media path P or path extension PX. Media position sensors 21, 22 are located adjacent to the point at which media is picked from each of removable media trays 100 while media position sensor 20 is positioned further downstream adjacent to print engine 7. Additional media position sensors may be located throughout media path P and a duplex path, when provided, and their positioning is a matter of design choice. Media position sensors, such as an optical interrupter or a flag-operated switch, detect the leading and trailing edges of each media sheet as it travels along the media path P or path extension PX.

Controller 3 includes a processor unit and associated memory 4, and may be formed as one or more Application Specific Integrated Circuits (ASICs). Memory 4 may be any volatile or non-volatile memory of combination thereof such as, for example, random access memory (RAM), read only memory (ROM), flash memory and/or non-volatile RAM (NVRAM). Alternatively, memory 4 may be in the form of a separate electronic memory (e.g., RAM, ROM, and/or NVRAM), a hard drive, a CD or DVD drive, or any memory device convenient for use with controller 3.

In FIG. 2, controller 3 is illustrated as being communicatively coupled with computer 60 via communication link 80 using a standard communication protocol, such as for example, universal serial bus (USB), Ethernet or IEEE 802.xx. Controller 3 is illustrated as being communicatively coupled with print engine 7, user interface 50, media position sensors 20-22 and controller 65 via communication links 81; 82, 83, 84, respectively. As used herein, the term "communication link" generally refers to a structure that facilitates electronic communication between two components, and may operate using wired or wireless technology. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11.

Print engine 7, and user interface 50 and controller 65 may include firmware modules 5 or software modules 6 maintained in memory 4 which may be performed by controller 3 or controller 65 or another processing element. Controller 3 serves to process print data and to operate print engine 7 and printing cartridge 8 during printing. Controller 3 may provide to computer 60 and/or to user interface 50 status indications and messages regarding the media, imaging device 2 itself or any of its subsystems, consumables status, etc. Computer 60 may provide operating commands to imaging device 2. Computer 60 may be located nearby imaging device 2 or remotely connected to imaging device 2 via an internal or external computer network Imaging device 2 may also be communicatively coupled to other imaging devices. However, in some circumstances, it may be desirable to operate imaging device 2 in a standalone mode. In the standalone mode, imaging device 2 is capable of functioning without a computer.

Computer 60 includes in its memory 61 a software program including program instructions that function as an imaging driver 62, e.g., printer driver software, for imaging device 2. Imaging driver 62 is in communication with controller 3 of image forming device 2 via communication link 80. Imaging driver 62 facilitates communication between imaging device 2 and computer 60. One aspect of imaging driver 62 may be, for example, to provide formatted print data to imaging device 2, and, more particularly, to print engine 4, to print an image. Controller 3 also communicates with a controller 65 in option assembly 9, via communication link 84, provided within each option assembly 9 that is attached to imaging device 2. Controller 65 operates various motors housed within option assembly 9 that position media for feeding, feed media from media path branches PB from the removable media tray 100 installed therein into media path P or media path extensions PX as well as feed media along media path extensions PX. Controllers 3, 65 control the feeding of media along media path P and control the travel of media along media path P and media path extensions PX. imaging device 2 in a standalone mode. Accordingly, all or a portion of imaging driver 62, or a similar driver, may be located in controller 3 of imaging device 2 so as to accommodate printing functionality when operating in the standalone mode.

Print engine 7 is may in one form be an electrophotographic print engine and printing cartridge 8 may be either black or color toner cartridges removably mounted in imaging device 2. The electrophotographic imaging process is well known in the art and, therefore, will be briefly described. During an imaging operation, a latent image is created on a photoconductive drum in print engine 7. Toner is transferred from the toner cartridge and metered onto the latent image on the photoconductive drum to create a toned image. The toned image is then transferred to a media sheet passing print engine 7, fused to the media sheet and sent to an output location 17. Controller 3 provides for the coordination of these activities occurring during the imaging process. While print engine 7 is illustrated as being an electrophotographic printer, those skilled in the art will recognize that print engine 7 may be, for example, an ink jet printer and one or more ink cartridges or ink tanks or a thermal transfer printer; other printer mechanisms and associated image forming material.

Each removable media tray 100 includes a media dam 120, a media storage area 122, a rack and gear assembly 200 that interfaces with a respective sensor array 300 mounted within housings 10, 40. A rear media restraint 400 is slidably mounted on a serrated track 130 in removable media trays 100, and, a rack 202 of a rack and gear assembly 200 is attached to rear media restraint 400 while an encoder gear 240 coupled to rack 202 interfaces with sensor array 300. Media sensor arrays 300, having a plurality of sensors, generally indicated at 302, are provided in imaging device 2 and each option assembly 9 to sense the position of encoder gear 240 which relates to the size of media being feed from removable media input trays 100. Four sensors 302 are shown, each have an output signal that combines to form a four-bit data signal providing the location of rear media restraint 400 within removable media tray 100. To determine media sizes such as Letter, A4, A6, Legal, etc. in each removable media tray 100, media sensor array 300 together with gear train 200 detects the location of the rear media restraint 400. Media sensor array 300 in option assembly 9 is shown in communication with controller 65 via communication link 85 while media sensor array 300 in imaging device 2 is shown in communication with controller 3 via communication link 84.

Media stack MS1 is shown in removable media tray 100 in imaging device 2 while media stack MS2 is shown in removable media tray 100 of option assembly 9. Media stack MS1 is shown having a length that is shorter than that of media stack MS2. Accordingly, the corresponding rear media restraint 400 in imaging device 2 is positioned forward of the rear media restraint 400 in option assembly 9. Similarly the digital output signal of the two sensor arrays 300 would differ due to the difference in location of rear media restraint 400.

Figure 3:
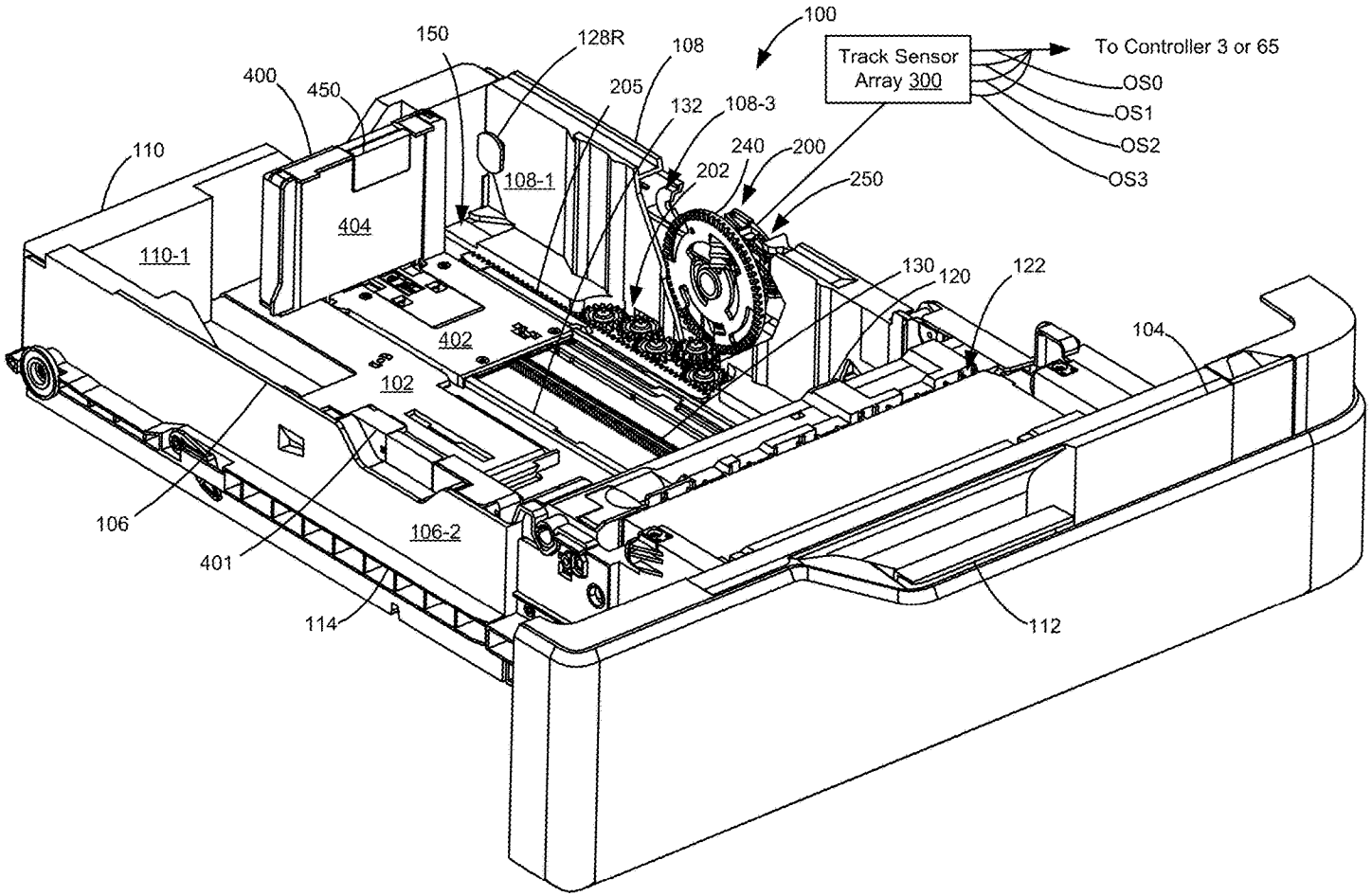
FIG. 3 is a perspective illustration of the removable media tray of FIG. 1 having a side wall partially removed to show the media length sensing system of the present disclosure.
Figure 4:
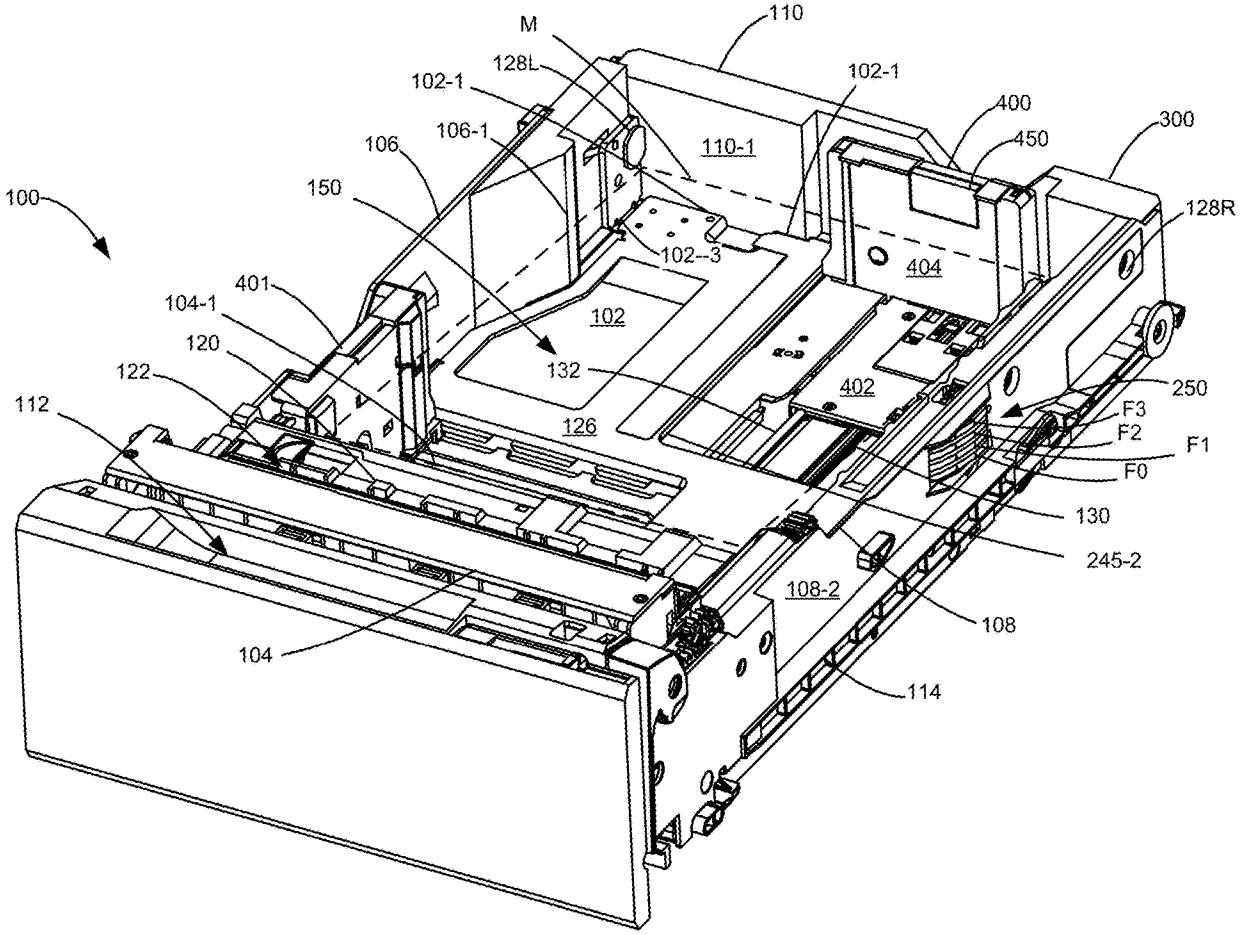
FIG. 4 is a top right perspective view of the removable media tray of FIG. 3.
Figure 5:
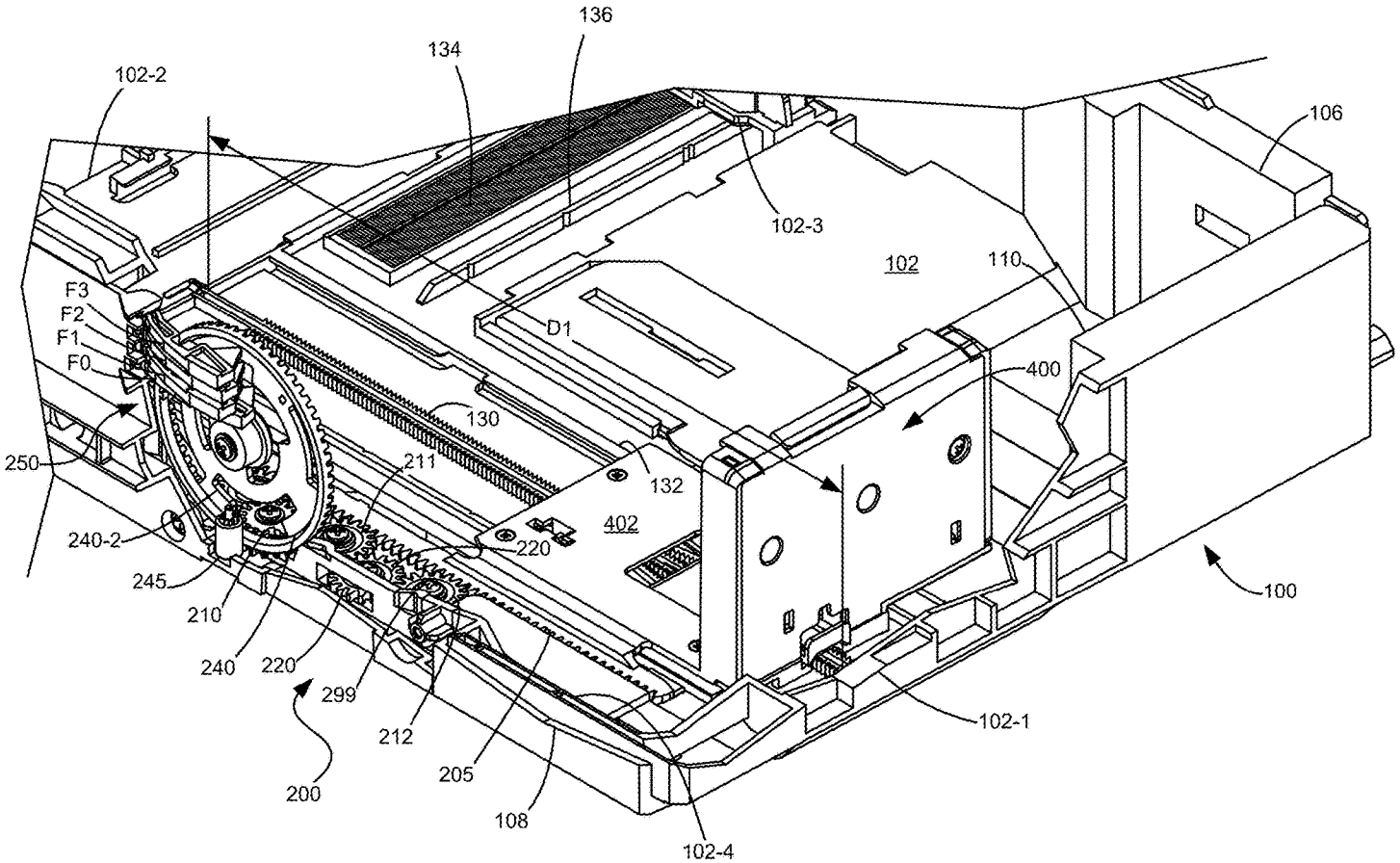
FIG. 5 is a rear right perspective cutaway view of the removable media tray of FIG. 3 illustrating the media length sensing system of the present disclosure.

Referring to FIGS. 3-5 removable media tray 100 is shown having a bottom 102 with a front wall 104, a left side wall 106 and a right side wall 108 and a rear wall 110 mounted on bottom 102. Walls 104, 106, 108, 110 may be integrally molded with bottom 102. A media storage area 150 is generally defined by bottom 102 and walls 104, 106, 108, 110. Bottom 102 further has a rear edge 102-1 and a front edge 102-2 that for purposes of description lies at the intersection of an inner face 104-1 of front wall 204 and bottom 102 (see FIG. 10). Similarly left and right edges 102-3, 102-4 of bottom 102 are at the intersection of inner faces 106-1, 108-1 of left and right side walls 106, 108, respectively. Rails 114 may be provided on the outer faces 106-2, 108-2 of left and right side wall 106, 108 for aiding in the insertion and removal of removable media tray 100. A media dam 120 is provided in an upper portion the inner face 104-1 of front wall 104 and is used to deflect media being fed from removable media tray 100 into the media path P or path extension PX. Feed-through channel 122 can be seen front wall 104 outboard of media dam 120. A lift plate 126, used to raise a media stack, is shown pivotally attached to left and right side walls 106, 108 at pivot posts 128L, 128R, respectively. Lift plate 126 is not shown in FIG. 3 in order to better view the media length sensing system of the present disclosure.

As illustrated, removable media tray 100 is sized to hold approximately 550 pages of 20 pound media which has a media stack height of about 59 mm Provided in each removable media tray 100 are one or more adjustable media restraints. A rear media restraint 400 and side media restraint 401 are shown placed at a rear and a side edge of the media storage area 120, to accommodate for different media widths. A media sheet M is shown in dashed line is positioned in media storage area 122 having a rear edge abutting rear media restraint 400 and a left side edge abutting side media restraint 401. Media storage area 122 has a length extending between media dam 120 and rear wall 110 of about 356 mm or longer. As is known in the art removable media tray may also be formed of a front portion and a rear tray extension allowing the length of the media storage area to be extended to accommodate media types such as Ledger or A3.

Media restraints 400, 401 are latchable and slidable along respective tracks 130, 134 provided on bottom 202. Tracks 130, 134 have serrations along their lengths that allow with media restraints 400, 401 to be latched into user selected locations. Track 130 extends a predetermined distance D1 from rear edge 102-1 toward front edge 102-2 of bottom 102 and parallel to left and right edges 102-3, 102-4 of bottom 102. Track 134 extends from a position adjacent left edge 102-3 toward right side edge 102-4 parallel to rear and front edges 102-1, 102-2 of bottom 102. Track 130 allows the rear media restraint 400 to be adjusted between a shortest designed-for media length and a longest designed-for media length. Similarly, track 134 allows for side edge media restraint 401 to be adjusted between the narrowest and widest designed-for media sizes. Guide rails 132, 136 from rear and side media restraints 400, 401, may be provided parallel to tracks 130, 134, respectively.

Removable media tray 100 is an edge referenced media tray meaning that the media is positioned against the front wall 104 and one of the side walls 106, 108 and aligned with the side wall that is being used as the reference edge. As shown, right side wall 108 serves as the reference walls. Media restraints 400, 401 act to bias and align the media with respect to the front and right side walls 104, 108, respectively. Removable media tray 100 may also be a centered reference removable media tray where, in addition to the rear media restraint, a left and a right side media restraint are provided and are used to center the media along the media path. The media length sensing system 200 and rear media restraint 400 of the present disclosure may be used with either design of removable media tray.

Rotatably mounted on right side wall 108 and bottom 102 of removable media tray 100 is a rack and gear assembly 200 including gear train 202 that operatively couples a rack 205 on rear media restraint 400 to the encoder gear 240. Mounted adjacent to encoder gear 240 on right side wall 108 is an encoder gear track follower 250, having four followers F0-F3, more readily seen in FIG. 5, that is schematically shown in FIG. 3 interfacing with a corresponding sensor array 300 shown having four corresponding output signals OS1-OS3 being transmitted to controller 3 or controller 65, as applicable. The followers F0-F3 function in a fashion to similar to cam followers and have one end mounted to right side wall 108 and the other free end positioned on encoder gear 240. Encoder gear 240 is rotatably mounted within a pocket 108-3 provided in right side wall 108.

Figure 6:
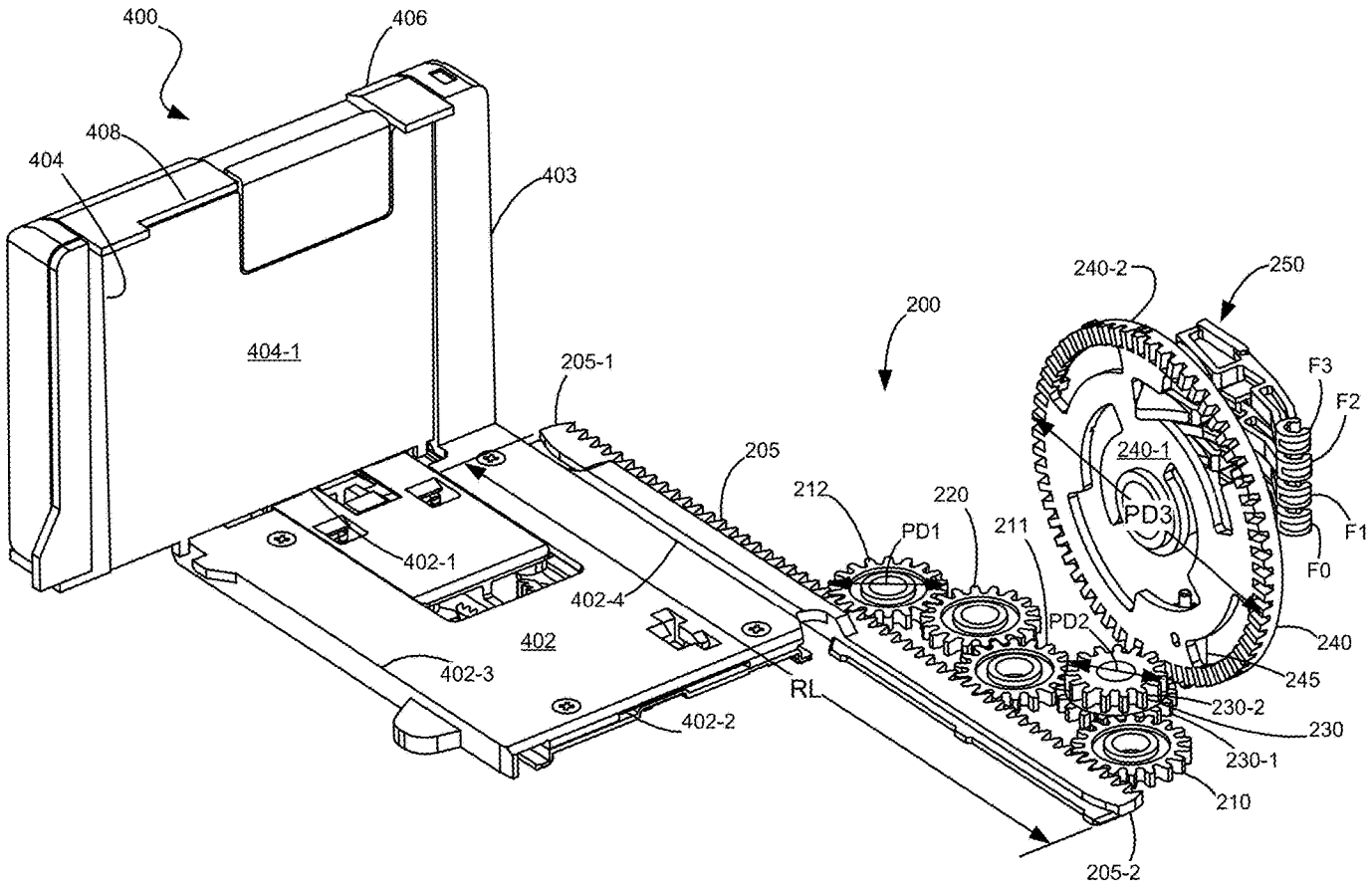
FIG. 6 is a perspective view of the media length sensing system of the present disclosure.

Referring to FIG. 6, the mechanical elements of the media length sensing system 200 are illustrated. As shown in FIG. 6, rear media restraint 400, rack and gear assembly 202, including encoder gear 240 and track follower array 250, are shown at their respective positions for Letter sized media. Bottom plate 402 of rear media restraint has rear, front left and right edges 402-1, 402-2, 402-3, 404-4, respectively. A housing 403 having a front plate 404 extends along rear edge 402-1. A rack 205, having a length RL, has a rear end 205-1 near rear edge 402-1, extends along the right edge 402-4 and is generally parallel to right wall 108 of removable media tray 100. A portion of rack 205 extends out from the front edge 402-2. The length RL of rack 205 is related to the number of rack gears 210 and idler gears 220 used in gear train 202.

Figure 25:
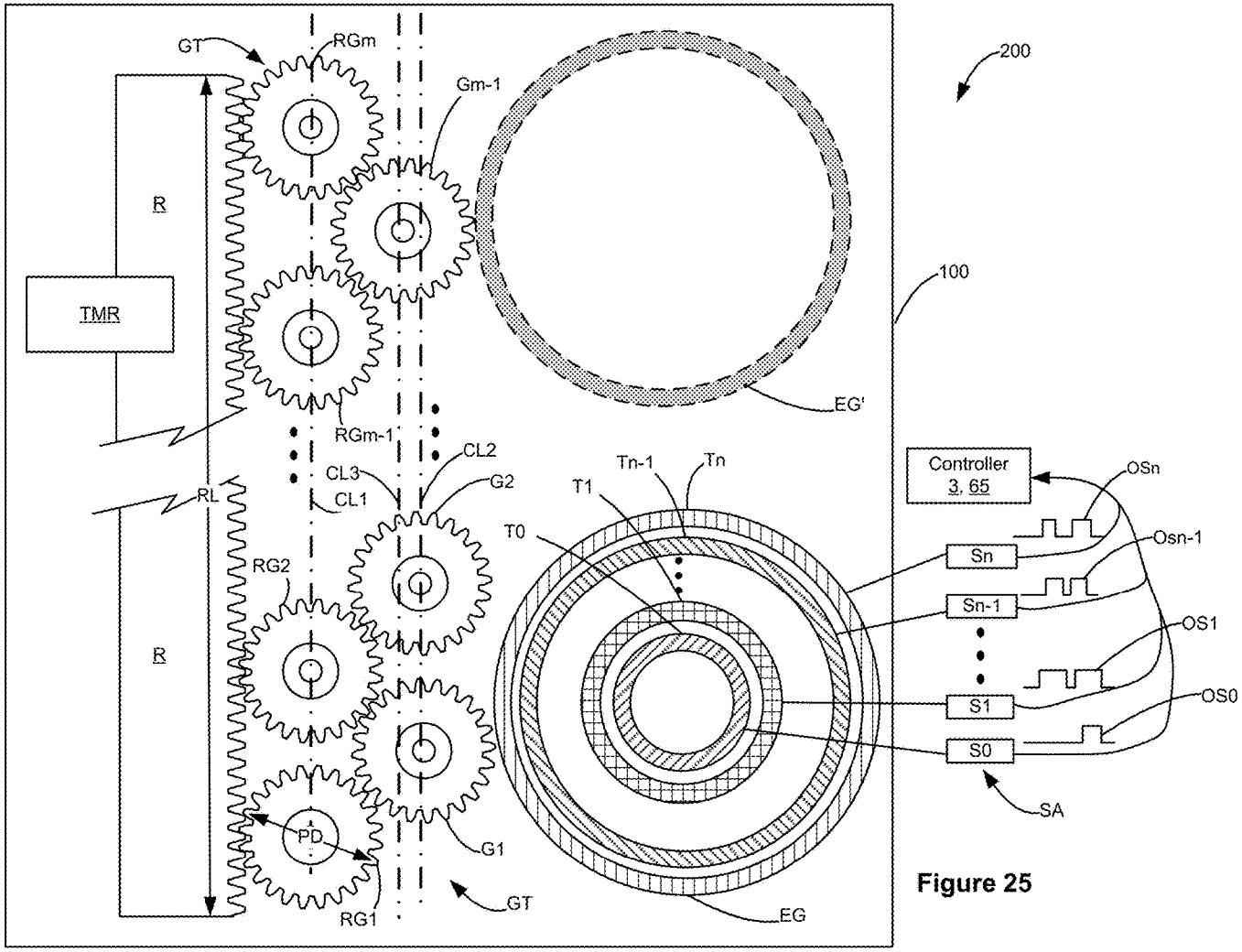
FIG. 25 is a schematic illustration of a generalized media length sensing system of the present disclosure.

As shown gear train 202 includes the three rack gears 210-212 that will either individually or in combination engage with rack 205 as media restraint 400 is moved along track 130. Compound gear 230 has a lower idler gear portion 230-1 that is coupled to rack gears 210, 211 while idler gear 220 is coupled between rack gears 211, 212. An upper transfer gear portion 230-2 of compound gear 230 is coupled to an inner face 240-1 of encoder gear 240 that is mounted on right side wall 108. Rack gears 210-212, idler gear 220 and compound gear 230 are all rotatably mounted to the bottom 102 of removable media tray 100 (e.g., see FIG. 10). A roller 245 is vertically mounted within pocket 108-3 and positioned to abut an outer face 240-2 of encoder gear 240. This arrangement helps to ensure that encoder gear 240 and transfer gear portions 230-2 of compound gear 230 do not slip as rear media restraint 400 is moved. Rack gears 210-212, idler gear 220 and compound gear 230 are all rotatably mounted to the bottom 102 of removable media tray 100. It will be recognized that compound gear 230 may be replaced by individual gears and that, as shown in FIG. 25, the idler portion may be coupled directed to encoder gear 240.

Figure 10:
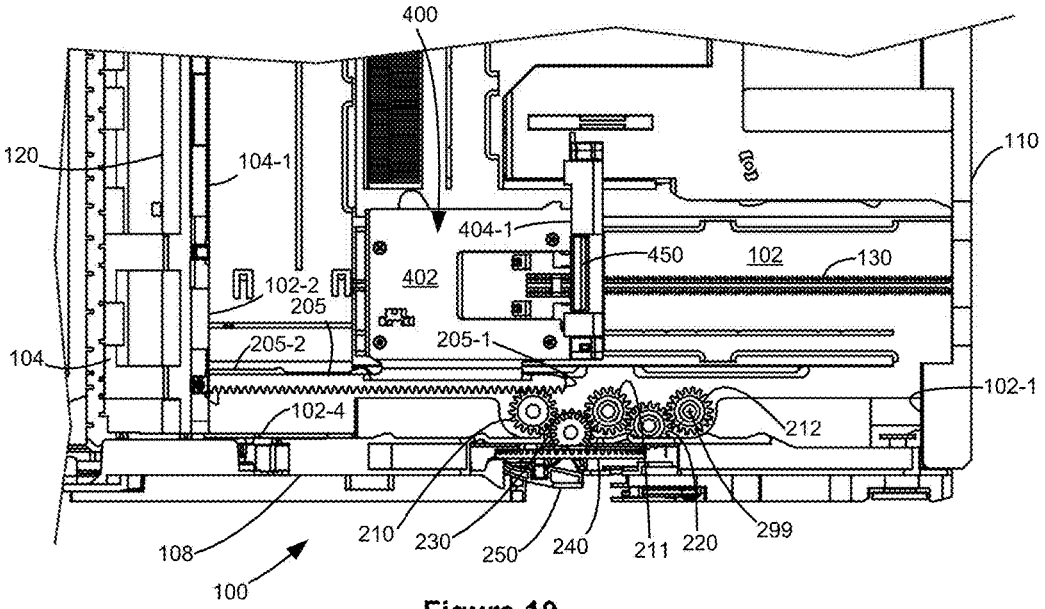
FIGS. 10-24 illustrate operation of the media length sensing system of the present disclosure moving from a shortest designed-for media length to a longest designed-for media length.

As explained with reference to FIG. 7, encoder gear 240 has a plurality of concentric circular tracks. Four tracks T0-T3 are shown with each track have a unique binary pattern—shown as a series of solid and open portions in each track. Track follower array 250 has a corresponding plurality of followers, four followers F0-F3. Followers F0-F3 are parallel cantilevered members having their respective free ends traveling along the corresponding track on the outer face 240-2 of encoder gear 240. As shown in FIG. 10 for example, followers F0-F3 also engage with corresponding sensor array 300 having sensors S0-S3, shown as switches S0-S3. Sensors S0-S3 have each have a respective output signal OS0-OS3 that is operatively coupled to controller 3 or controller 65, as applicable. The four output signals OS1-OS3 form a 4-bit data signal. As each follower traverses from a solid portion to an open portion of its respective track the corresponding output signal of the respective sensor changes state.

Example design parameters for rack 205, rack gears 210-212, idler gear 220, compound gear 230, and encoder gear 240 are presented in Table 1.

TABLE 1

| Component | Length/Teeth (mm) | Reference Pitch Circle Diameter (mm) | Gear Module | Outer Diameter (mm) |
|---|---|---|---|---|
| Rack | 156.24/50 teeth | 18.00 | 1 | |
| Rack Gear 210-212 | NA | 18.00 | 1 | |
| Idler Gear 220 | NA | 18.00 | 1 | |
| Compound Gear Transfer Gear Portion 230-2 | NA | 15.00 | 1 | |
| Compound Gear Idler Gear Portion 230-1 | NA | 18.00 | 1 | |
| Encoder Gear 240 | NA | 59.83 | 1 | 63.00 |
| Roller 245 | 10.25/NA | NA | NA | 7.00 |

The values given in Table 1 are illustrative, are a matter of design choice and should not be considered as limiting. Rack gears 210-212, idler gear 220, and the idler portion 230-1 of compound gear 230 have the same pitch circle diameter PD1, transfer gear portion 230-2 of compound gear 230 has a pitch circle diameter PD2 while encoder gear 240 has a pitch circle diameter PD3. The components of rack and gear track 200 may have gear module values in the range of about 0.5 to about 3.0. This gear module range allows these components to loosely engage with one another making translation of rear media restraint 400 along track 130 easier.

Figure 7:
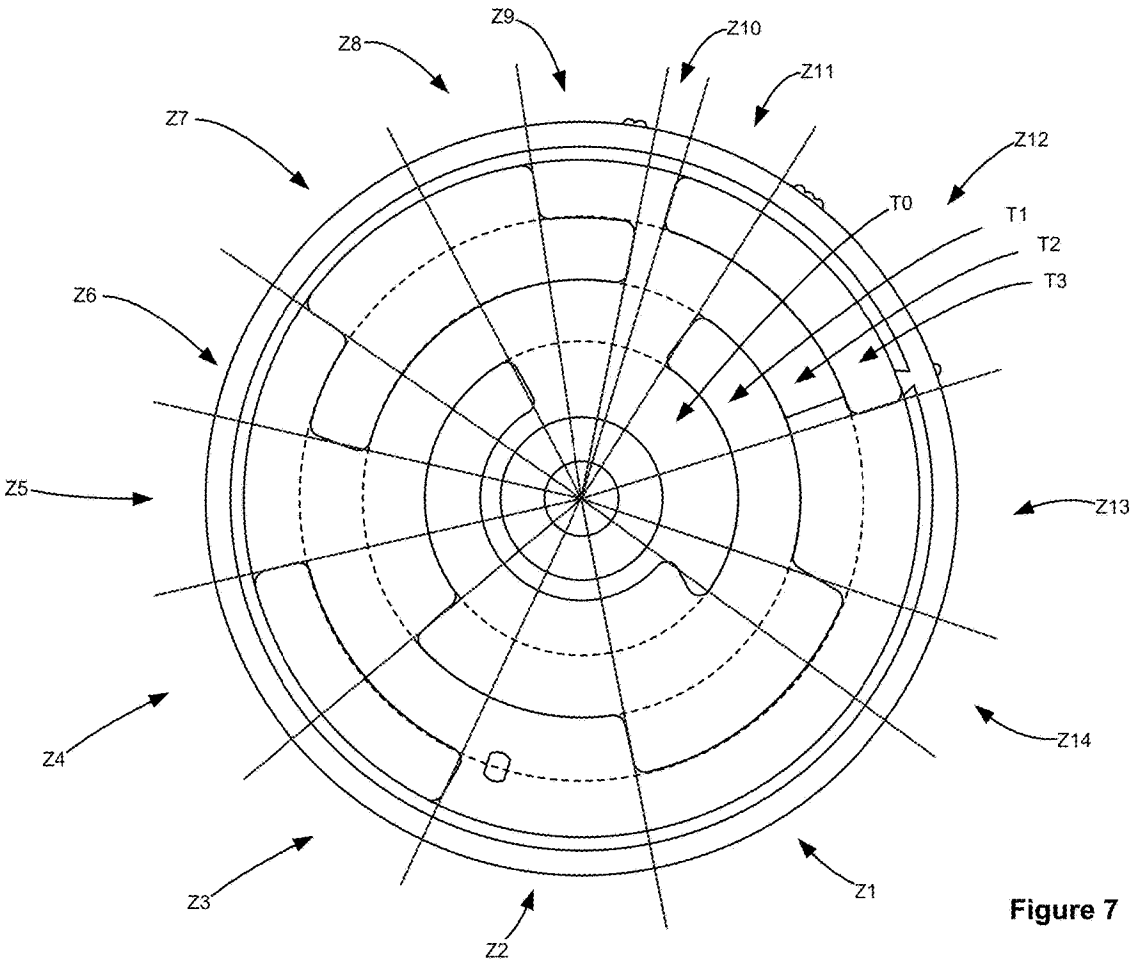
FIG. 7 is an illustration of an encoder gear used with the media length sensing system of the present disclosure illustrating four encoder tracks with each track providing a unique binary pattern formed from closed and open portions in each track that when sensed provide a 4-bit data signal.

Referring to FIG. 7 and Table 2, details of encoder gear 240 are shown. As illustrated encoder gear 240 has four concentric tracks T0-T3, going from innermost to outermost. Encoder gear 240 is also divided into fourteen zones Z1-Z14 which span across the four track T0-T3. Each track has a unique binary pattern formed of open sections and solid sections. As is readily recognized, 16 unique binary values corresponding to decimal 0-15 are possible with the illustrated track configurations. However, as shown in Table 2, binary value 0000 is reserved for the condition of when removable media tray 100 is pulled out or removed from imaging device 2 and is not present on encoder gear 240. As seen in Table 2, each zone has a minimum and maximum value which corresponds to a linear position in millimeters of rear media restraint 400 with respect to the inner face 104-1 of front wall 104. Zones Z1-Z9, Z11, and Z12-Z14 are positions of media restraint 400 representative of media lengths from A6 through Legal listed in Table 2. Zones Z10, Z12 corresponding to binary values 1111, 1010, respectively, are not used. Also, the binary value of 1000 is not present on encoder gear 240 and no zone is designated for this value. Table 2 is arranged from binary/decimal values 0000/0 through 1111/15. For zones Z1 through Z14 to be in linear sequence of 147 mm to 356 mm (A6 media through Legal media) the decimal values sequence would be 1, 3, 2, 6, 7, 5, 4, 12, 13, 15, 14, 10, 11, and 9. Further zones Z5, Z7, Z13, and Z14 are used for more than one media type length. For example zone Z5 is used for Statement media and three types of envelope media lengths that fall between 215.9 mm to 229 mm and zone Z13 is used for Folio and Oficio media lengths that fall between 330.2 mm to 340.1 mm. It will be recognized that the number of tracks provided, the encoding thereof, the number of zones and zone lengths are a matter of design choice and not of limitation.

TABLE 2

| Media | | | Zone | | | Sensor or Switch No. | | | | |
|---|---|---|---|---|---|---|---|---|---|---|
| Media Designation | Media Type | Media Length (mm) | Zone No. | Zone Min (mm) | Zone Max (mm) | S3 $2^3$ | S2 $2^2$ | S1 $2^1$ | S0 $2^0$ | Decimal Value |
| | | | | | | Binary Value | | | | |
| Tray Removed | | | NA | | | 0 | 0 | 0 | 0 | 0 |
| A6 | paper | 148.0 | Z1 | 147 | 157 | 0 | 0 | 0 | 1 | 1 |
| Envelope-7 | envelope | 190.5 | Z3 | 183 | 196 | 0 | 0 | 1 | 0 | 2 |
| Not Used | | | Z2 | 157 | 183 | 0 | 0 | 1 | 1 | 3 |
| Env_B5 | envelope | 250.0 | Z7 | 246 | 261 | 0 | 1 | 0 | 0 | 4 |
| JIS_ B5 | paper | 257.0 | | | | | | | | |
| Env_10 | envelope | 241.3 | Z6 | 233 | 246 | 0 | 1 | 0 | 10 | 5 |
| A5 | paper | 210.0 | Z4 | 196 | 214 | 0 | 1 | 1 | 0 | 6 |
| statement | paper | 215.9 | Z5 | 214 | 233 | 0 | 1 | 1 | 1 | 7 |
| Env_Long | envelope | 220.0 | | | | | | | | |
| Env_ 9 | envelope | 225.4 | | | | | | | | |
| Env_C5 | envelope | 229.0 | | | | | | | | |
| Not Used | | | NA | 1 | 0 | 0 | 0 | 8 | | |
| Legal | paper | 355.6 | Z14 | 352 | 356 | 1 | 0 | 0 | 1 | 9 |
| Other Env | envelope | 355.6 | | | | | | | | |
| Not Used | | | Z12 | 305 | 326 | 1 | 0 | 1 | 0 | 10 |
| Folio | paper | 330.2 | Z13 | 326 | 352 | 1 | 0 | 1 | 1 | 11 |
| Oficio | paper | 340.1 | | | | | | | | |
| Executive | paper | 266.7 | Z8 | 261 | 274 | 1 | 1 | 0 | 0 | 12 |
| Letter | paper | 279.4 | Z9 | 274 | 285 | 1 | 1 | 0 | 1 | 13 |
| A4 | paper | 297.0 | Z11 | 293 | 305 | 1 | 1 | 1 | 0 | 14 |
| Not used | | | Z10 | 285 | 293 | 1 | 1 | 1 | 1 | 15 |

Figure 8A:
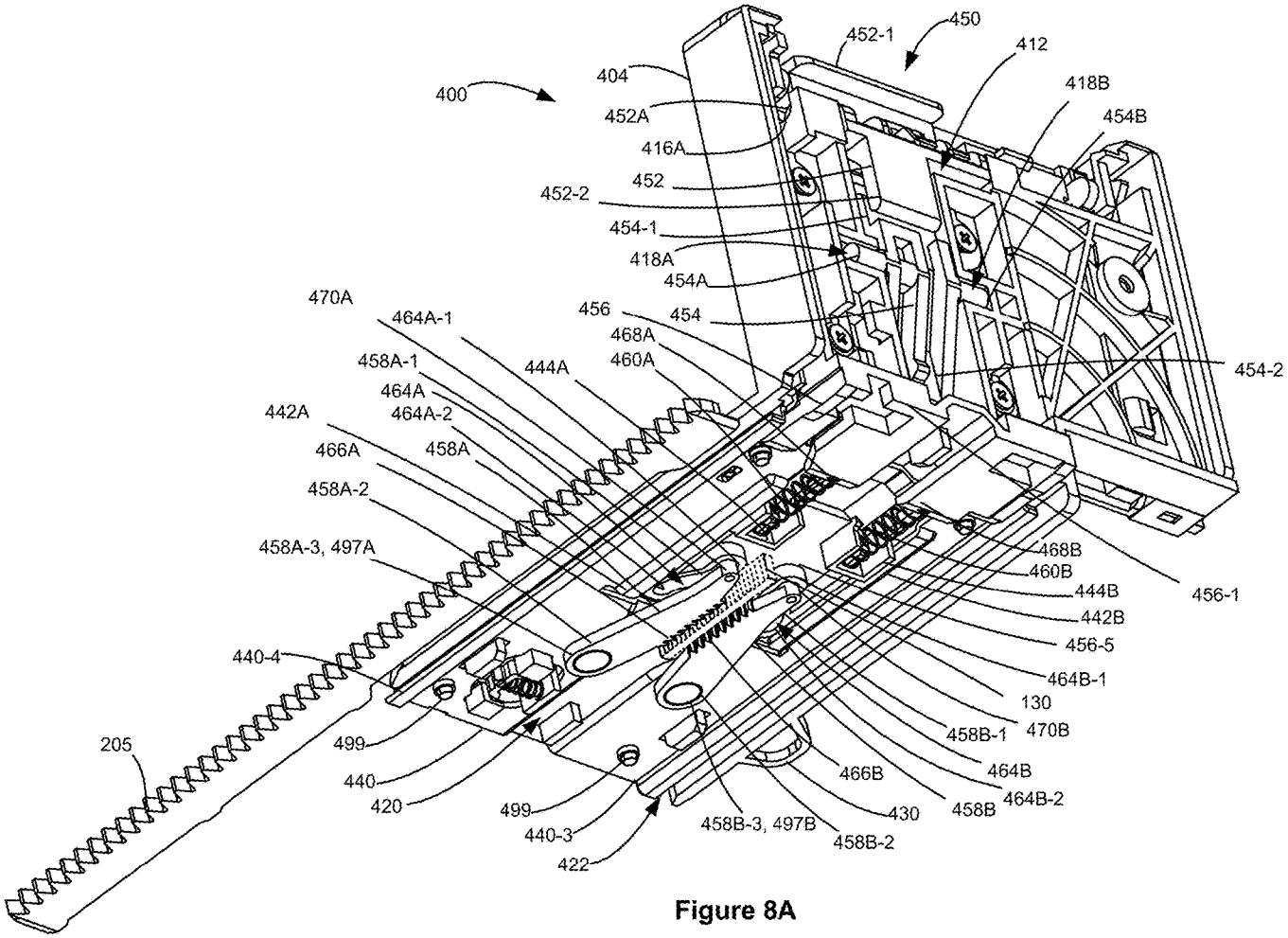
FIGS. 8A-8B are front and rear views of the media restraint illustrated of FIG. 6 having a rear plate removed to show the latching mechanism where
Figure 8B:
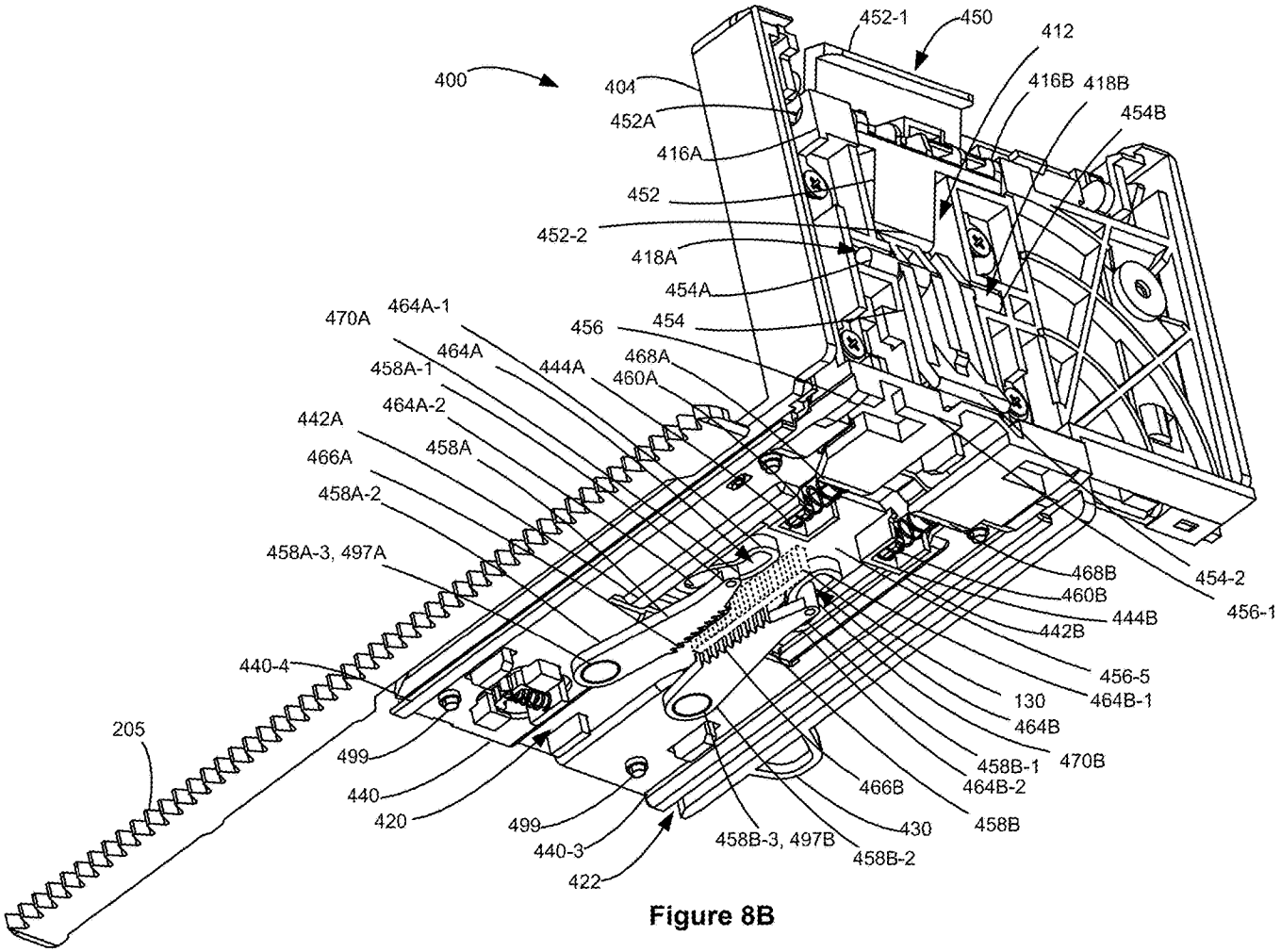
Figure 9B:
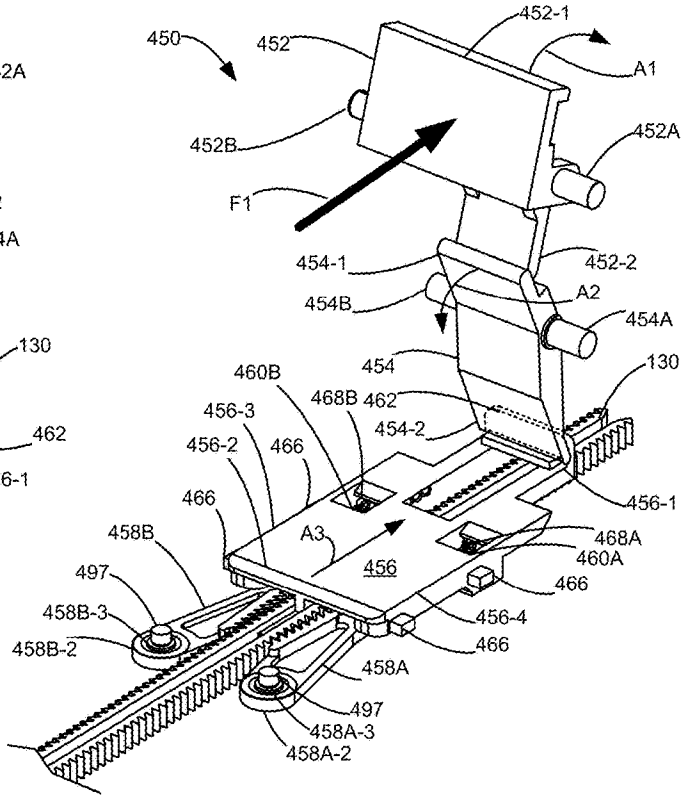
Figure 9B Prior Art
FIGS. 9A-9B are perspective illustrations of a prior art latching mechanism used with the media restraint of FIGS. 8A-8B where

Referring to FIGS. 8A-9B, an example embodiment of media restraint 400 and its components is shown. Media restraint 400 may have several different configurations including different configuration of latching mechanism housed therein. The latching mechanism used to latch and unlatch media restraint 400 is a matter of design choice and should not be considered as limiting. FIGS. 8A, 9A show media restraint 400 and its latching mechanism 450 in first or latched state and FIGS. 8B, 9B show media restraint 400 and latching mechanism 450 in an unlatched state. In FIGS. 8A, 8B, a rear and top plate of housing 403 have been removed. FIGS. 9A-9B show a known example of latching mechanism 450 in the latched and unlatched states.

In FIGS. 6, and 8A-8B example media restraint 400 is shown having a bottom plate 402 having rear, front, left and right edges, 402-1-402-4, respectively. A front plate 404, a rear plate 406 spaced from front plate 404 are mounted on bottom plate 402. A top plate 408 joins front and rear plates 404, 406 completing a housing 403. Front plate 404 aligns with a rear edge 402-1 of bottom plate 402. The outer face 404-1 of front plate 404 acts as a media restraint surface to the rear edge of media placed within media storage area 120 of removable media tray 100. Rack 205 is shown extending along right edge 402-2 from a position adjacent rear edge 402-1 and projecting out beyond front edge 402-2. Channels 420, 422 are provided in the bottom plate 402 of media restraint 400 for track 130 and guide rail 132, respectively.

A support plate 440 is shown attached to the undersurface 402-5 of bottom plate 402 by fasteners 490. Latching mechanism 450 is mounted between the front and rear plates 404, 406 and is used to slidably engage the media restraint 400 to the track 130 in removable media tray 100. Front plate 404 may have a recess 412 for receiving latching mechanism 450. An opening 409 is provided in top plate 408 to access latching mechanism 450. Top plate 408 may be integrally molded as part of rear plate 406 or as part of front plate 404. Rear plate 406 is attached to front plate 404 by one or more fasteners 499.

Figure 9A:
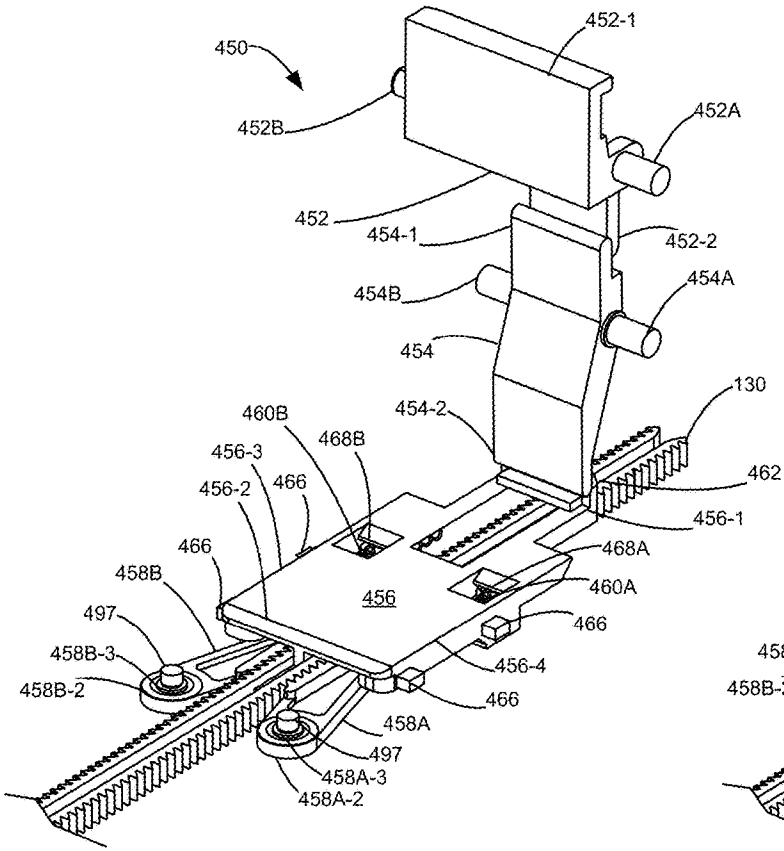
Figure 9A Prior Art

In FIGS. 8A-8B rear and top plates 406, 408 have been removed to show example latching mechanism 450 positioned within a recess 412 provided in front plate 404 of media restraint 400. In FIGS. 8A-8B example rear media restraint 400 is shown in a first latched position and a second actuated or unlatched position with respect to track 130. FIGS. 9A-9B show example latching mechanism 450 in the engaged or latched position and in the actuated or unlatched position with respect to track 130. Example latching mechanism 450 is a known design and includes an actuator linkage 452, a transfer linkage 454, a sled plate 456, a first and a second latching cam plates 458A, 458B and a first and a second biasing member 460A, 460B, shown as coil springs 460A, 460B.

Referring to FIGS. 9A-9B, actuator link 452 has a top end 452-1 and a bottom end 452-2 and has opposed pivot arms 452A, 453B extending therefrom approximately midway between the top and bottom ends 452-1, 452-2. Transfer link 454 has a top end 454-2 and a bottom end 452-2 and has an opposed pivot arms 454A, 454B extending therefrom approximately midway between the top and bottom ends 454-1, 454-2. Pivots arms 452A, 452B are received in respective cradles 416A, 416B provided on front plate 404 while pivot arms 454A, 454B are received in respective slots 418A, 418B also provided in front plate 404 below respective cradles 416A, 416B. The bottom end 452-1 of actuator link 452 overlaps the top end 454-1 of transfer link 454 which is between bottom end 452-1 and front plate 406.

Sled plate 456 has a rear edge 456-1, a front edge 456-2, a left edge 456-3, a right edge 456-4 and a under surface 456-5. Sled plate 456 is positioned below and parallel to bottom plate 402. Depending from rear edge 456-1 is a upwardly extending lip 462 that abuts the bottom end 454-2 of transfer link 454 which is rearward of lip 462. A pair of mirror image curved camming channels 464A, 464B, are provided on under surface 456-5 of sled plate 456. The rear ends 464A-1, 464B-1 of camming channels 464A, 464B are spaced apart but are closer to one another then fronts ends 464A-2, 464B-2 of camming channels 464A, 464B. Camming channels 464A, 464B diverge going rear to the front. Projections 466 outwardly extend from the left and right edges of sled plate 456. Projections 466 are slidably received into left and rights L-rails 442A, 442B depending down from support plate 440 and parallel to the left and right edges thereof.

Latching camming plates 458A, 458B have respective front ends 458A-2, 458B-2 pivotally mounted to support plate 440. Openings 458A-3, 458B-3 in latching camming plates 458A, 454B and fasteners 497A, 497B are provided for this mounting. Rear ends 458A-1, 458B-1 of latching camming plates 458A, 458B, have upwardly depending cylindrical members 470A, 470B, that are slidably received into respective camming channels 464A, 464B and serve as cam followers. Serrated portions 466A, 466B are provided on the inner sides of camming plates 458A, 458B and engage with track 230 when media restraint 400 is in a first or latched position.

Biasing members 460A, 460B, shown as coil springs 460A, 460B, are mounted between seats 468A, 468B provided on sled plate 456 and respective seats 444A, 444B provided on support plate 440. Latching cam plates 458A, 458B, camming channels 464A, 464B, L-rails 442A, 442B, seats 444A, 444B, 468A, 468B, and biasing members 460A, 460B are in a mirrored configuration about track 130 when media restraint 400 is installed in removable media tray 100.

Operation of latching mechanism 450 will be briefly explained with reference to FIGS. 8A-9B. In FIGS. 8A, 9A, latching cam plates 458 are engaged with track 130. Cam followers 470A, 470B are positioned within camming channels 464A, 464B at the rear ends 464A-1, 464B-1 thereof. When the pinching force, indicated by force vector F1 in FIG. 9B, is applied by a user to the top end 452-1 of actuator link 452, actuator link 452 pivots rearward as indicated by directional arrow A1 in FIG. 9B. This action causes the bottom 452-2 of actuator link to rotate transfer link 454 forward as indicated by directional arrow A2. In turn, the bottom end 454-1 of transfer link 454 translates sled plate 456 rearward as indicated by directional arrow A3 compressing biasing members 460A, 460B. This in turn translates camming channels 464A, 464B rearward. As camming channels 464A, 464B translate rearward, cam followers 470A, 470B slide in these channels and diverge until they reach the camming channel front ends 464A-2, 464B-2. As cam followers 470A, 470B diverge, latching cam plates 458A, 458B, pivot away from engagement with track 130 allowing media restraint 400 to be moved. Upon removal of the pinching force, biasing members 460A, 460B translate sled plate 456 forward causing cam followers 470A, 470B to return to their position at the camming slot rear ends 464A-1, 464B-1. This in turn pivots latching cam plates 458A, 458B back into engagement with track 130 latching media restraint 400 to track 130. The function of latching mechanism 450 may be accomplished by a wide variety of mechanism. Accordingly, example latching mechanism 450 should not be considered as a limitation of the present disclosure.

Referring to FIGS. 10-24, operation of the media length sensing system will be described. FIG. 10 shows media restraint 400 positioned on track 130 at the position corresponding to that is used for a shortest designed-for media length, such as A6, and this could be considered as a home position for both media restraint 400 and encoder gear 240 while in FIG. 21 media restraint 400 is positioned on track 130 at the position corresponding to that is used for a longest designed-for media length, such as Legal, and this position could be termed as an end position for both media restraint 400 and encoder gear 240. Conversely, the home and end positions can be reversed where the home positions would be when media restraint 400 and encoder gear 240 are at the longest-designed-for media length and the respective end positions would be at the shortest designed-for media length.

Figure 11:
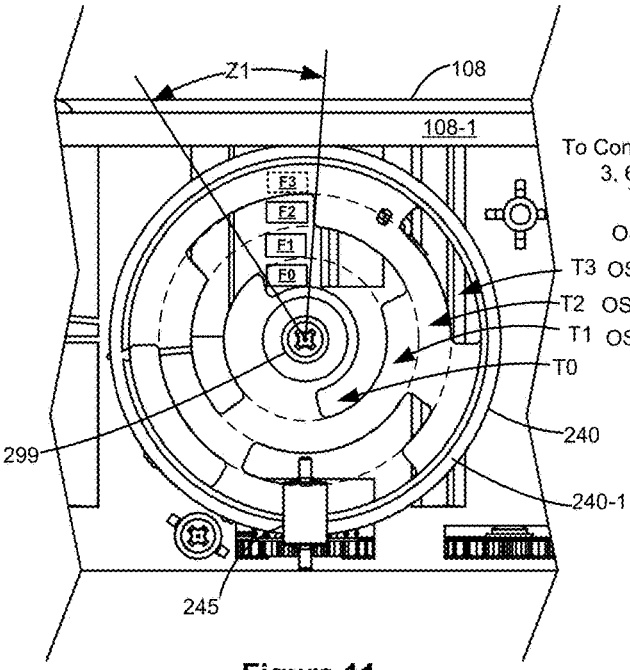
Figure 12:
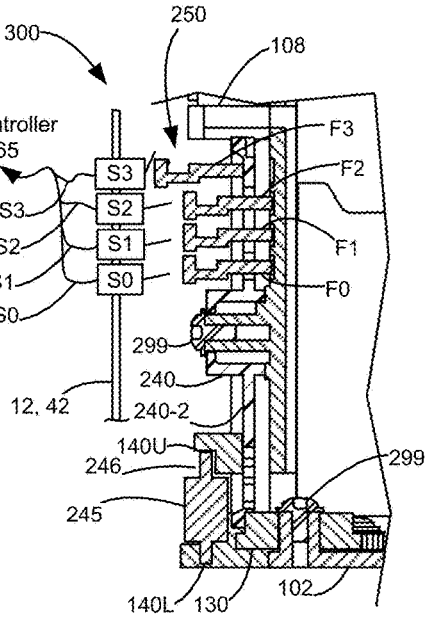

FIG. 10 shows media restraint 400 positioned on track 130 at the position corresponding to that is used for a shortest designed-for media length, such as A6 media with FIGS. 11-12 showing the corresponding positions of encoder gear 240, encoder gear track follower array 250 and sensor array 300. A front end 205-2 of rack 205 is adjacent to the inner face 104-1 of front wall 104 while the rear end 205-1 of rack 205 is engaged with rack gear 210. As shown in FIGS. 11-12 followers F0-F2 fall within open portions of track T0-T2 while follower F3 rests on a solid portion of track T3. Followers F0-F3 are within zone Z1 of encoder gear 240. As shown in FIG. 12, sensors S0-S2, shown as switches S0-S2, are shown in a first state as open switches while sensor S3, shown as switch S3, is shown in a second state as a closed switch. The corresponding output signals OS0-OS3 are output to either controller 3, or 65, depending on the location of removable media tray 100.

Figure 13:
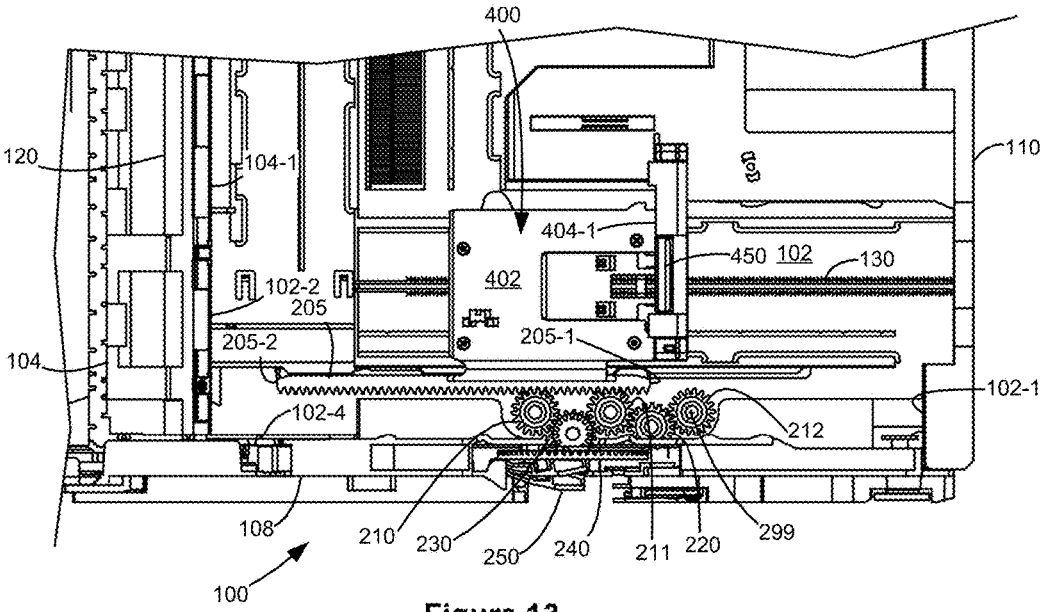
Figure 14:
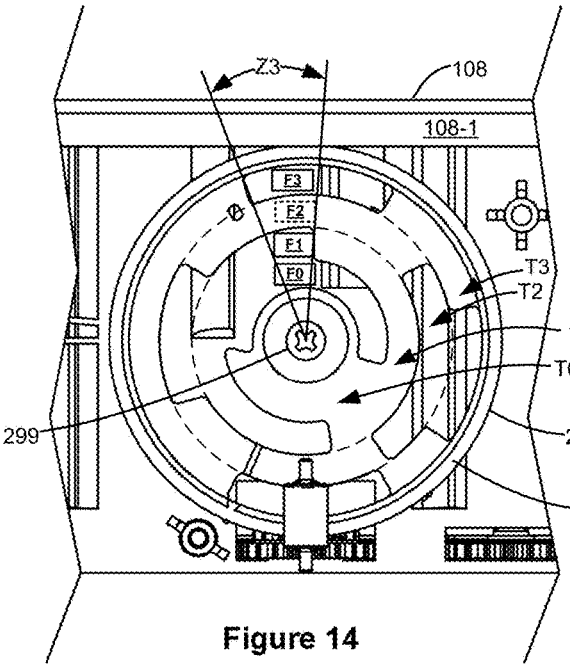
Figure 15:
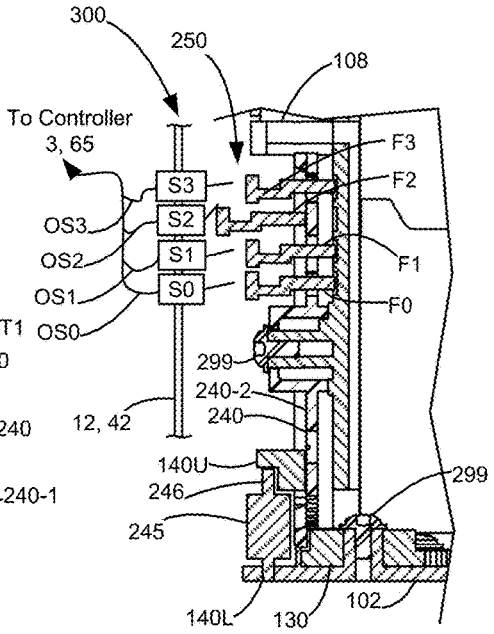

In FIG. 13 media restraint 400 has been translated along track 130 to the position corresponding to media lengths for JIS-B5 media and an envelope B5 with FIGS. 14-15 showing the corresponding positions of encoder gear 240, encoder gear track follower array 250 and sensor array 300. The front end 205-2 of rack 205 has moved rearward from the inner face 104-1 of front wall 104 while the rear end 205-1 is now engaged with two rack gears, rack gears 210, 211. During the translation of media restraint 400, the action of rack 205 upon rack gear 210 and then rack gear 211 rotates, via compound gear 230, encoder gear 240 from zone Z1 into zone Z3. As shown in FIGS. 14-15 followers F0, F1, F3 fall within open portions of tracks T0, T1, T3 while follower F2 rests on a solid portion of track T2. As shown in FIG. 15, sensors S0, S1, S3, shown as switches S0, S1, S3, are shown in a first state as open switches while sensor S3, shown as switch S3, is shown in a second state as a closed switch. The corresponding output signals OS0-OS3 are output to either controller 3, or 65.

Figure 16:
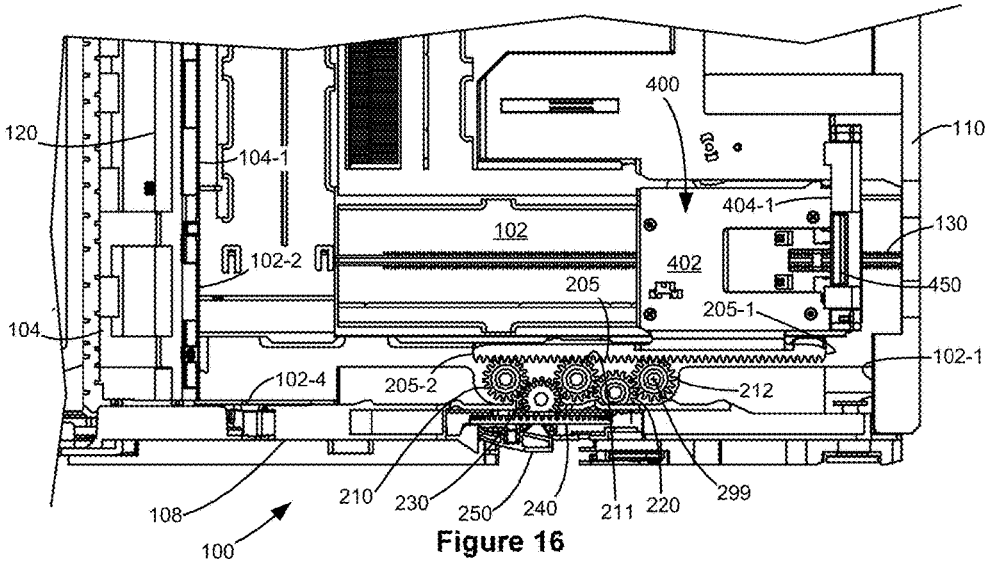
Figure 17:
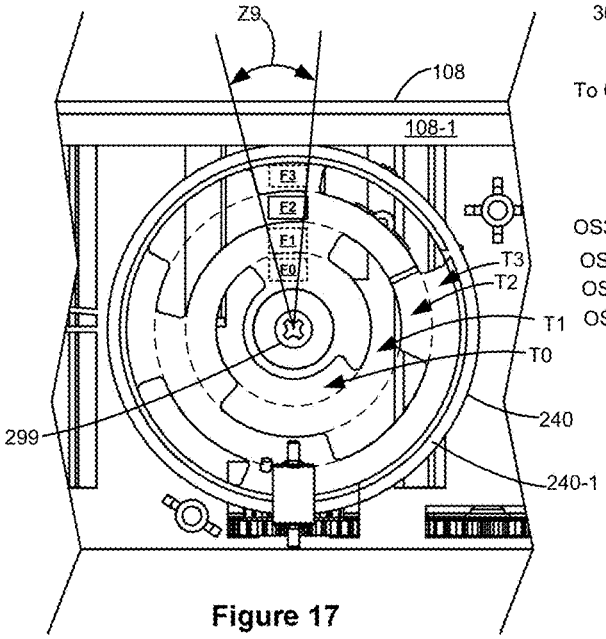
Figure 18:
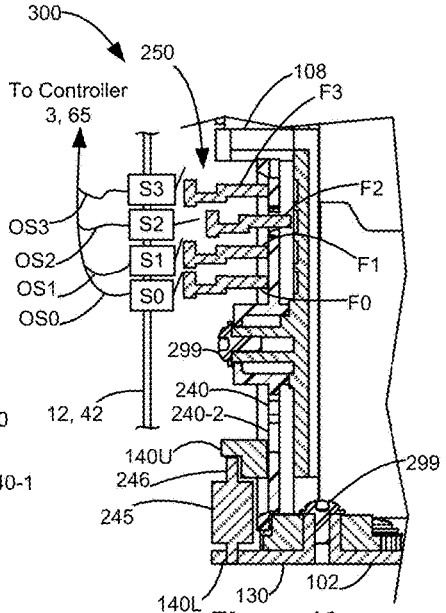

In FIG. 16 media restraint 400 has been translated farther along track 130 to the position corresponding to a media length for Letter media with FIGS. 17-18 showing the corresponding positions of encoder gear 240, encoder gear track follower array 250 and sensor array 300. The front end 205-2 of rack 205 has moved into engagement with rack gear 210 and rack 250 is engaged with all three rack gears 210-212. Again the translation of media restraint 400 results in the rotation of encoder gear 240 into zone Z9. As shown in FIGS. 17-18 followers F0, F1, F3 rest on solid or closed portions of tracks T0, T1, T3 while follower F2 falls within an open portion of track T2. As shown in FIG. 18, sensors S0, S1, S3, shown as switches S0, S1, S3, are shown in a second state as closed switches while sensor S2, shown as switch S2, is shown in the first state as an open switch. The corresponding output signals OS0-OS3 are output to either controller 3, or 65.

Figure 19:
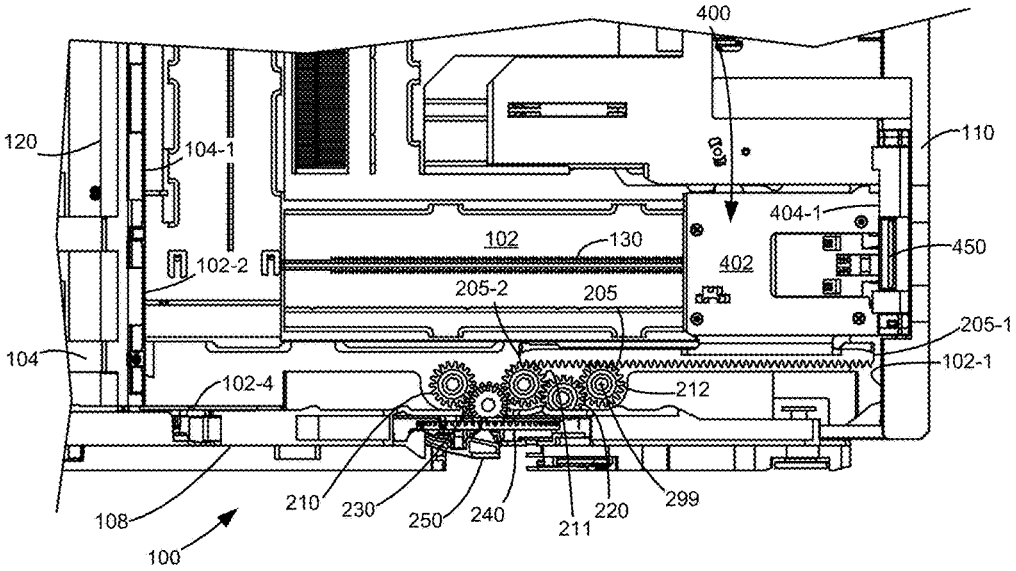
Figure 20:
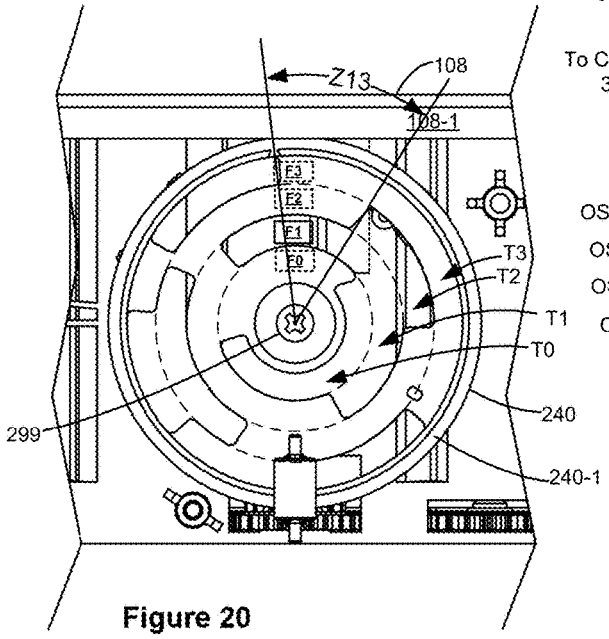
Figure 21:
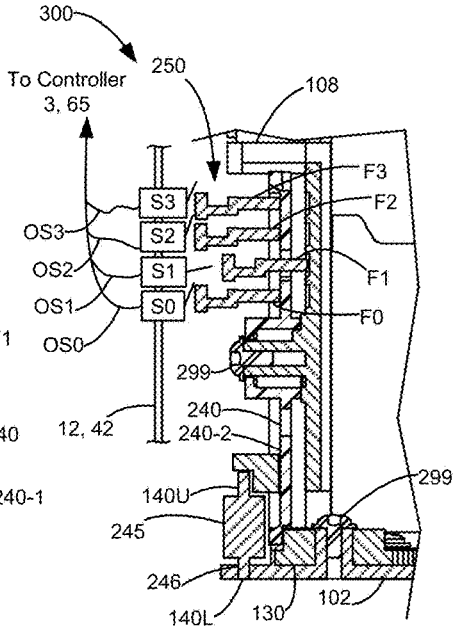

In FIG. 19 media restraint 400 has been translated farther along track 130 to an intermediate position corresponding to a media lengths for Oficio and Folio media with FIGS. 20-21 showing the corresponding positions of encoder gear 240, encoder gear track follower array 250 and sensor array 300. The front end 205-2 of rack 205 has moved into engagement with rack gear 211 and rack 205 is engaged with rack gears 211-212. Again the translation of media restraint 400 results in the rotation of encoder gear 240 into zone Z13. As shown in FIGS. 20-21 followers F0, F2, F3 rest on solid or closed portions of tracks T0, T2, T3 while follower F1 falls within open portions of track T1. As shown in FIG. 21, sensors S0, S2, S3, shown as switches S0, S2, S3, are shown in a second state as closed switches while sensor S1, shown as switch S1 is shown in the first state as an open switch. The corresponding output signals OS0-OS3 are output to either controller 3, or 65.

Figure 22:
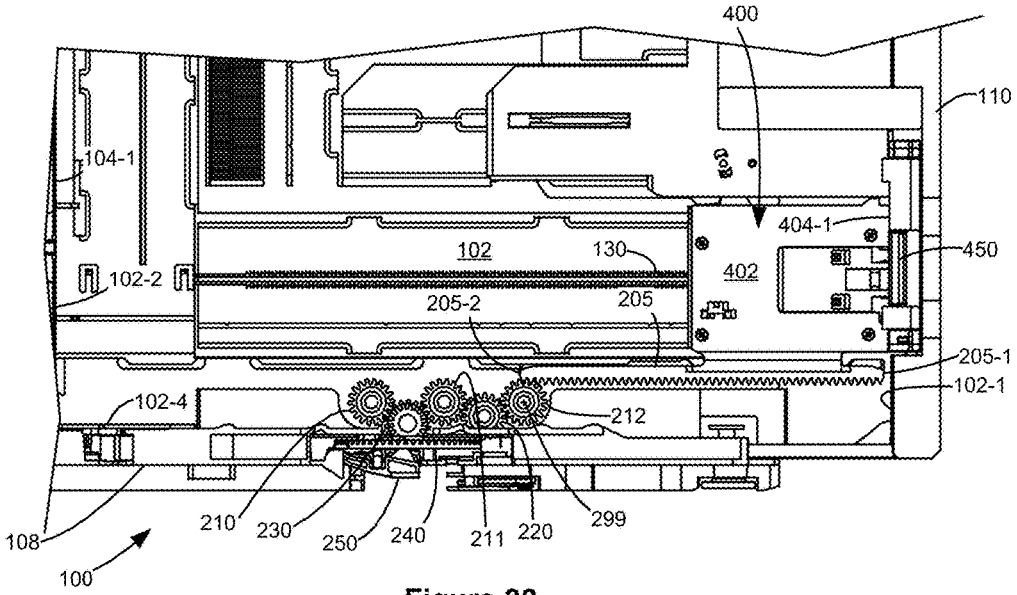
Figure 23:
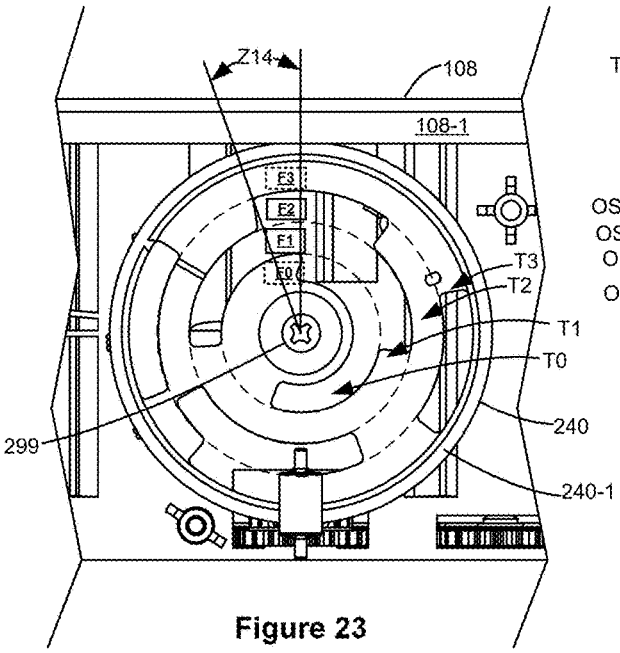
Figure 24:
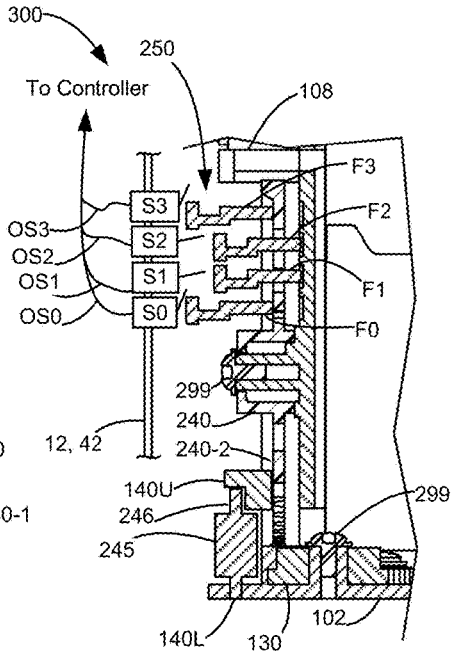

In FIG. 22 media restraint 400 has been translated farther along track 130 to the position corresponding to a media length for Legal media with FIGS. 23-24 showing the corresponding positions of encoder gear 240, encoder gear track follower array 250 and sensor array 300. Removable media tray 100 has been extended, using a sliding tray extension 160, to accommodate this longer media length. The front end 205-2 of rack 205 has moved into engagement with rack gear 212 with the remainder of rack 205 being disengaged from the rack gears 210-212. Again, the translation of media restraint 400 results in the rotation of encoder gear 240 into zone Z14. As shown in FIGS. 23-24 followers F0, F3 rest on solid or closed portions of tracks T0, T3 while followers F1, F2 fall within open portions of tracks T1, T2. As shown in FIG. 24, sensors S0, S3, shown as switches S0, S3, are shown in a second state as closed switches while sensors S1, S2 shown as switches S1, S2 are shown in the first state as open switches. The corresponding output signals OS0-OS3 are output to either controller 3, or 65.

As illustrated in FIGS. 10-24, rack 205 remains in contact with at least one of the rack gears 210-212 as media restraint 400 moves between the positions for the shortest designed-for media lengths and the longest designed-for media lengths. This ensures that should the position of media restraint 400 be adjusted to a new media length when removable media tray 100 is removed from imaging device 2, encoder gear 240 will also be rotated to the corresponding zone for that media length and encoder gear track follower array 250 will adjust to the new position of encoder gear 240. Upon reinsertion of removable media tray 100 into imaging device 2, the new positions of followers F0-F3 in follower array 250 will result in changing the outputs of sensor array 300 allowing controller 3 or 65 to determine that a new length of media is now present in the removable media tray 100.

FIG. 25 schematically illustrates a generalized form of the media length sensing system 200 of the present disclosure. Tray media restraint TMR includes a rack R having a rack length RL. Gear train GT comprises m rack gears, shown as rack gears RG1-RGm, that will engage with rack R as tray media restraint TMR is moved between positions corresponding to the shortest and longest designed-for media lengths and m−1 idler gears, shown as idler gears G1-Gm−1, each of which engages with the adjacent rack gears. Encoder gear EG is shown engaging with idler gear G1. Encoder gear EG' illustrates an alternate connection to gear train GT at idler gear Gm−1. Rack gears RG1-RGm are on mounted along a common rotational centerline CL1. Idler gears may be mounted on a second common rotational centerline CL2 as shown with idler gears G1, G2 or on different rotational centerlines as shown with idler gear G1 on centerline CL2, and idler gear Gm−1 shown on rotational centerline CL3. As noted previously, the rack length RL is dependent on the number of rack gears used and the longest designed-for media length that removable media tray 100 is to accommodate. For a given longest designed-for media length, such as Legal media, adding a rack gear and corresponding idler gear to gear train GT allows the rack length RL to be decreased by a minimum of OD where PD is the pitch diameter of the added rack gear, as indicated on rack gear RG1. Similarly, removing a rack gear and its companion idler gear from gear train GT increases the needed rack length RL by substantially the same amount. The actual increase or reduction in rack length would be somewhat larger due to the separation needed between adjacent rack gears and the need to mount the common idler gear in between the two adjacent rack gears.

Encoder gear EG has a plurality of n concentric tracks, shown as tracks T0-Tn. Each track has a unique binary pattern represented by the different cross hatch patterns. A sensor array SA provides a sensor S0-Sn for each of tracks T0-Tn, respectively. Each of sensors S0-Sn has a corresponding output signal OS0-OSn that is communicated to the controller 3 or 65. The output signals OS0-OSn form an N-bit data signal that represent the $2^N$ positions of the encoder gear EG which in turn are representative, in part, of a plurality of positions of the tray media restraint TMR within the removable media tray 100 and the absence of the removable media tray 100 within the imaging device 2. The plurality of positions of the tray media restraint TMR correspond to a plurality of designed-for media lengths such as those described in Table 2. Typically, where n=3 allows for up to 7 different designed-for media lengths plus indication of absence of removable media tray or where n=4 allows for up to 15 different designed-for media lengths plus indication of absence of removable media tray. The phrase "absence of removable media tray" includes conditions where removable media tray 100 is completely removed from imaging device 2 and where removable media tray 100 is partially pulled out of imaging device 2 such as when removable media tray 100 is being loaded with media.

FIGS. 26-29 illustrate alternate embodiments for the sensor array and encoder gear. Although not shown but as would be readily understood by a person of ordinary skill in the art, the various sensor arrays are in communication with a controller in the imaging device and each of the tracks on the encoder gears has a unique binary pattern. Each sensor array is comprised of n sensors providing a n-bit data signal to the controller as previously described.

Figure 27:
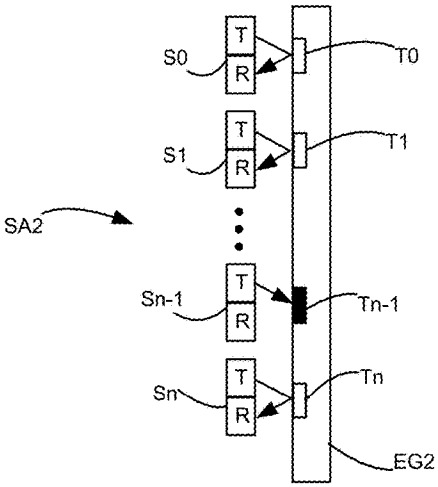
FIGS. 26-29 schematically illustrate various sensor and encoder gear configurations where
Figure 26:
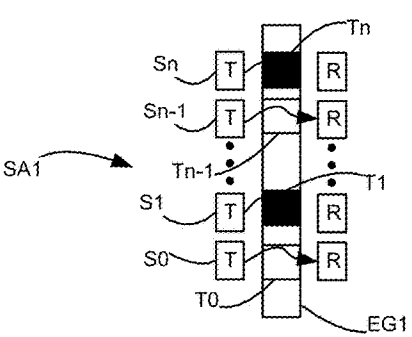

In FIGS. 26-27 each sensor includes a light source or optical transmitter T and a photoreceptor R having an optical path therebetween. The optical path may be direct or reflective or indirect. The photoreceptor R provides an output signal to the controller. A sensor is aligned with a corresponding encoder gear track and as the encoder track rotates the optical path is blocked and unblocked by the unique binary pattern of the corresponding encoder gear track with the output signal changing between a first state and a second state as the optical path is blocked and unblocked. In FIG. 26 the sensor array SA1 is comprised of n pairs, S0-Sn, of optical transmitters T and opposed photoreceptors R aligned with respective tracks T0-Tn on encoder gear EG1 where a light beam is either passed through or blocked by the respective track on encoder gear EG1 using open or optically transmissive portions and solid portions. As shown there by the black blocks, the photoreceptors R of sensors S1, S3 are blocked while the photoreceptors R of sensors S0, S2 are not. In FIG. 27 the sensor array SA2 is comprised of n pairs S0-Sn of optical transmitters T and photoreceptors R aligned with respective tracks T0-Tn on encoder gear EG2 where a light beam is either reflected from the face of encoder gear EG2 or not. As shown there by the black blocks, the photoreceptor R of sensor Sn−1 has not received a reflected light beam while the photoreceptors R of sensors S0, S1, Sn have received a light beam reflected from a reflective surface indicated by the small white blocks at tracks T0, T1, and Tn. In FIG. 27 the order of the tracks is reversed from that shown in FIG. 26.

Figure 29:
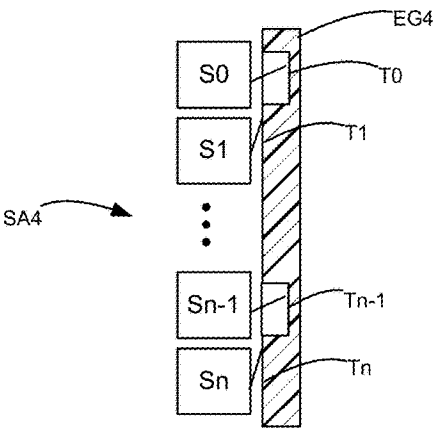
Figure 28:
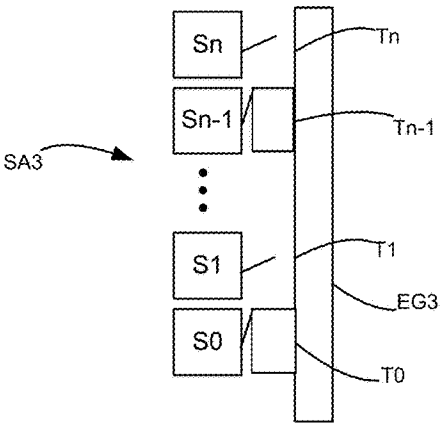

In FIG. 28 the sensor array SA3 is comprised of n switches, S0-Sn, aligned with respective tracks T0-Tn on encoder gear EG3. The switches are actuated by raised portions along each track. As shown there switches S0, Sn−1 are actuated on tracks T0, Tn−1 while switches S1, Sn are not. In FIG. 29 the sensor array SA4 is comprised of n switches, S0-Sn, aligned with respective tracks T0-Tn on encoder gear EG4. The switches are actuated by the solid portion formed by the face of encoder gear EG4 and are deactuated by recesses in the face of encoder gear EG4 along each track. As shown there switches S0, Sn−1 are deactuated on tracks T0, Tn−1 while switches S1, Sn are actuated. Again in FIG. 29 the order of the tracks is reversed from that shown in FIG. 28.

FIGS. 26-29 are meant to show that the configuration of the sensor array and the encoder gear and the type of sensors used is not a limitation of the present disclosure.

The foregoing description of several embodiments of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media tray for an imaging device, the removable media tray comprising:

a bottom for holding media to be fed to the imaging device;

a side wall attached to along a side edge of the bottom surface;

a serrated track positioned on an upper surface of the bottom parallel to the side wall;

a user-actuated media restraint for restraining a rear edge of the media when present, the media restraint being slidably engageable with the track, the media restraint including a bottom plate having a rack extending along a side edge thereof parallel to the side wall;

a gear train engaged with the rack, the gear training including:

an M rack gears mounted into the removable media tray and spaced apart along a common centerline that is parallel to the side wall with at least one rack gear engaged with the rack as the media restraint is moved along the track;

an M−1 idler gears, one idler gear rotatably coupled to adjacent rack gears and rotatably mounted to the removable media tray; and, an N track encoder gear rotatably mounted to the removable media tray and rotatably coupled to one of the M−1 idler gears, each track of the encoder gear having a unique binary pattern, wherein M is at least 2 and N is at least 3;

and, an encoder gear sensor assembly having N sensors with N output signals in communication with a controller of the imaging device, the N sensors and N output signals corresponding to the N tracks of the encoder gear, each sensor sensing the unique binary pattern of the corresponding track of the encoder gear and providing the corresponding output signal representative of the sensed unique binary pattern, a combination of the N output signals form a N-bit data signal having $2^N$ values representative of a plurality of positions of the media restraint along the track and of the absence of the removable media tray in the imaging device where the plurality of positions correspond to a plurality of designed-for media lengths.

2. The removable media tray of claim 1 wherein, N is 4.

3. The removable media tray of claim 1 wherein M is 3.

4. The removable media tray of claim 1 wherein, the shortest designed-for media length is A6 media and the longest designed-for media length is Legal media.

5. The removable media tray of claim 1 wherein, each sensor includes a cantilevered member and a switch having a two-state output in communication with the controller, the cantilevered member mounted in the removable media tray adjacent to the encoder gear, the cantilevered member having a free end engaged with the corresponding encoder gear track and with the switch, wherein, as the encoder gear rotates, the free end of the cantilever member rises and falls causing the two-state output of the switch to toggle between a first state and a second state.

6. The removable media tray of claim 1 wherein, each sensor includes a light source and a photoreceptor having an optical path therebetween, the photoreceptor providing the output signal to the controller for corresponding encoder gear track wherein, as the encoder gear track rotates the optical path is blocked and unblocked by the unique binary pattern of the corresponding encoder gear track with the output signal changing between a first state and a second state as the optical path is blocked and unblocked.

7. The removable media tray of claim 1 wherein, the encoder gear is rotatably mounted to the side wall and gear train further includes an idler roll vertically and rotatably mounted on the side wall between a rear face of the encoder gear and the side wall, the idler roll being in contact with the rear face of the encoder gear.

8. A removable media tray for an imaging device, the removable media tray comprising:

a bottom for holding media to be fed to the imaging device;

a side wall attached along a side edge of the bottom;

a serrated track positioned on an upper surface of the bottom parallel to the side wall;

a user-actuated media restraint for restraining a rear edge of the media when present, the media restraint being slidably engageable with the track, the media restraint including a bottom plate having a rack extending along a side edge thereof parallel to the side wall, media restraint having a home position and an end position on the track;

a gear train including:

a first and a second rack gear rotatably mounted to the bottom and spaced apart along a common centerline that is parallel to the side wall, at least one of the first and second rack gears coupled to the rack on the media restraint as the media restraint moves along the track;

a compound gear rotatably mounted to the bottom, the compound gear including an idler gear portion and a transfer gear portion, the idler gear portion coupled to the first and second rack gears; and, an N track encoder gear where N is at least 3 rotatably mounted to an inner face of the side wall and rotatably coupled to the transfer gear portion, the encoder gear having a home position corresponding to the home position of the media restraint, the home position of the encoder gear indicating one of a shortest designed-for media length and a longest designed-for media length, and an end position corresponding to the end position of the media restraint, the end position of the encoder gear indicating a respective one of the longest designed-for media length and the shortest designed-for media length, each track of the encoder gear having a unique binary pattern;

and, an encoder gear sensor assembly having N sensors with N output signals in communication with a controller of the imaging device, the N sensors and N output signals corresponding to the N tracks of the encoder gear, each sensor sensing the unique binary pattern of the corresponding track of the encoder gear as the encoder gear rotates between its home and end positions and providing the corresponding output signal representative of the sensed unique binary pattern, a combination of the N output signals forming a N-bit data signal having $2^N$ values representative of a plurality of positions of the media restraint along the track and of the absence of the removable media tray in the imaging device where the plurality of positions correspond to a plurality of zones each zone representing at least one designed-for media length, wherein, as the media restraint travels along the track between its home and end positions, the encoder gear rotates between its home position and end positions, the N sensors sense the rotation of their corresponding encoder gear tracks and provide the N-bit binary signal representative of the position of the encoder gear as its moves between its home position and its end position through a plurality of positions corresponding to a plurality of designed-for media lengths.

9. The removable media tray of claim 8 wherein, N is 4.

10. The removable media tray of claim 8 wherein, the shortest designed-for media length is A6 media and the longest designed-for media length is Legal media.

11. The removable media tray of claim 8 wherein, each sensor includes a cantilevered member and a switch having a two-state output in communication with the controller, the cantilevered member mounted to the side wall adjacent to the encoder gear, the cantilevered member having a free end engaged with the corresponding encoder gear track and with the switch, wherein as the encoder gear rotates the free end of the cantilever member rises and falls which in turn causes the two-state output of the switch to toggle between a first state and a second state.

12. The removable media tray of claim 8 wherein, each sensor includes a light source and a photoreceptor having an optical path therebetween, the photoreceptor providing the output signal to the controller for corresponding encoder gear track wherein, as the encoder gear track rotates the optical path is blocked and unblocked by the unique binary pattern of the corresponding encoder gear track with the output signal changing between a first state and a second state as the optical path is blocked and unblocked.

13. The removable media tray of claim 8 wherein, the gear train further includes an idler roll vertically and rotatably mounted on the side wall between a rear face of the encoder gear and the side wall, the idler roll in contact with the rear face of the encoder gear.

14. A removable media tray for an imaging device, the removable media tray comprising:

a bottom having mounted thereon a front wall, a rear wall, and two side walls defining a media storage area for holding media to be fed to the imaging device;

a track in the media storage area, the track having a plurality of serrations along a length thereof, the track positioned parallel to the side walls;

a user-actuated media restraint for restraining a rear edge of the media when present, the media restraint being slidably engageable with the track and having a first state latched to the track, and, when actuated, a second state unlatched from the track allowing the media restraint to slide along the track, the media restraint having a home position at a shortest designed-for media length and an end position at a longest designed-for media length, the media restraint including a rack extending parallel to the track, the rack having a front end and rear end, and, a gear train engaged with the rack, the gear train including:

a first, a second and a third rack gear rotatably mounted to the bottom and spaced apart along a common centerline parallel to the side walls, at least one of the first, second and third rack gears being engaged with the rack on the media restraint as the media restraint moves between its home and end positions;

an four-track encoder gear rotatably mounted to an inner face of the side wall, the encoder gear having a home and an end position to corresponding to the home and end positions of the media restraint, each track of the encoder gear having a unique binary pattern;

a compound gear rotatably mounted to the bottom, the compound gear including an idler gear portion and a transfer gear portion, the idler gear portion coupled between one of the first and second rack gears and the second and third rack gear, the transfer gear portion coupled to a front face of the four-track encoder gear;

a second idler gear rotatably mounted to the bottom and coupled between the other of the first and second rack gears and the second and third rack gears; and an idler roll vertically and rotatably mounted on the side wall between a rear face of the encoder gear and the side wall, the idler roll in contact with the rear face of the encoder gear;

and, an encoder gear sensor assembly having four sensors with four output signals in communication with a controller of the imaging device, the four sensors and four output signals correspond to the four tracks of the encoder gear, each sensor sensing the unique binary pattern of the corresponding track of the encoder gear and providing the corresponding output signal representative of the sensed unique binary pattern, the four output signals forming a four-bit data signal having values from zero through 15 where each value is representative of one of the absence of the removable media tray from the imaging device and a designed-for media length where the zero value represents the absence of the removable media tray, the value 1 represents one of the shortest designed-for media length and the longest designed-for media length, and the 14 value represents the other of the shortest designed-for media length and the longest designed-for media length with at least a portion of the remaining values of 2 through 13 each being representative of unique media length having a magnitude between the shortest and longest designed-for media lengths.

15. The removable media tray of claim 14 wherein, with media restraint positioned at its home position, the rear end of rack is engaged with the first rack gear and the encoder gear is in its home position, when the media restraint is slid along the track toward its end position, the first rack gear and idler gear that rotates the encoder gear away from its home position, upon continued sliding of the media restraint, the rear end of the rack engages the second rack gear while continuing to engage with the first rack gear rotating the encoder gear to a new position, upon further continued sliding of the media restraint, the rear end of the rack engages the third rack gear with the rack continuing to engage the first and second rack gears with the encoder gear rotating to another new position, upon still further continued sliding of the media restraint, the front end of the rack disengages from the first rack gear with the rack continuing to engage the second and third rack gears with the encoder gear rotating to another new position, and, upon the media restraint reaching its end position, only the front end of the rack is engaged the third rack gear and the encoder gear reaches its end position.

16. The removable media tray of claim 14 wherein, the shortest designed-for media length is A6 media and the longest designed-for media length is Legal media.

17. The removable media tray of claim 14 wherein, each sensor includes a light source and a photoreceptor having an optical path therebetween, the photoreceptor providing the output signal to the controller for corresponding encoder gear track wherein, as the encoder track rotates the optical path is blocked and unblocked by the unique binary pattern of the corresponding encoder gear track with the output signal changing between a first state and a second state as the optical path is blocked and unblocked.

18. The removable media tray of claim 14 wherein, when a new rack gear is added to the gear train, a rack length of the rack is decreased by an amount approximately equal to $\pi PD$ where PD is the pitch diameter of the new rack gear.

19. The removable media tray of claim 14 wherein, when one of the first and third rack gears is removed from the gear train a rack length of the rack is increased by an amount substantially equal to $\pi PD$ where PD is the pitch diameter of the removed rack gear.

20. The removable media tray of claim 14 wherein, the rack, each rack gear, and idler gear have substantially the same pitch diameter.

21. The removable media tray of claim 14 wherein, the rack, each rack gear, idler gear, and encoder gear have the substantially the same gear module.

22. The removable media tray of claim 21 wherein, the gear module is in the range of about 0.5 to about 3.0.

* * * * *